US007115805B1

(12) United States Patent
Vandervoort

(10) Patent No.: US 7,115,805 B1
(45) Date of Patent: Oct. 3, 2006

(54) SYSTEM FOR PLAYING PERCUSSION INSTRUMENTS WITH FEET

(76) Inventor: Paul B. Vandervoort, 35 N. Edison Way, #10, Reno, NV (US) 89502-2351

( * ) Notice: Subject to any disclaimer, the term of this patent is extended or adjusted under 35 U.S.C. 154(b) by 227 days.

(21) Appl. No.: 10/896,122

(22) Filed: Jul. 21, 2004

Related U.S. Application Data

(60) Provisional application No. 60/489,033, filed on Jul. 22, 2003.

(51) Int. Cl.
*G10D 13/02* (2006.01)

(52) U.S. Cl. ..... 84/422.1; 84/422.3

(58) Field of Classification Search ..... 84/422.1, 84/422.2, 422.3
See application file for complete search history.

(56) References Cited

U.S. PATENT DOCUMENTS

| | | | | |
|---|---|---|---|---|
| 3,125,921 | A | 3/1964 | Korosh | |
| 3,747,464 | A * | 7/1973 | Russell | 84/422.1 |
| 4,520,710 | A * | 6/1985 | Elliott, Jr. | 84/422.1 |
| 4,756,224 | A * | 7/1988 | Lombardi | 84/422.1 |
| 5,438,903 | A * | 8/1995 | Cropek | 84/422.3 |
| 6,003,822 | A * | 12/1999 | Kurosaki | 248/161 |
| 6,075,192 | A * | 6/2000 | Hoshino | 84/422.3 |
| 6,166,312 | A * | 12/2000 | Brewster et al. | 84/422.1 |
| 6,278,046 | B1 * | 8/2001 | Sikra et al. | 84/422.1 |
| 6,316,708 | B1 * | 11/2001 | Kuppers | 84/422.3 |
| 6,794,565 | B1 * | 9/2004 | Green | 84/421 |
| 6,894,210 | B1 * | 5/2005 | Lombardi | 84/422.1 |
| 6,977,333 | B1 * | 12/2005 | Sutej | 84/422.3 |

FOREIGN PATENT DOCUMENTS

| | | |
|---|---|---|
| CH | 98101 | 10/1921 |
| FR | 637951 | 5/1928 |
| FR | 764649 | 5/1934 |
| FR | 44476 E | 2/1935 |
| GB | 185227 | 9/1922 |
| GB | 2146162 | 4/1985 |
| GB | 2234045 | 1/1991 |

* cited by examiner

*Primary Examiner*—Gary F. Paumen

(57) ABSTRACT

A method whereby a musician may play drums with his/her feet is disclosed. Foot pedals are provided, which are pressed by the underside of the musician's feet, such as heels or toes. Various linkages may transfer downward pedal movement to a drum-striking mechanism. The drum-striking mechanism includes a striking device which may resemble the drum-striking end of a drumstick, and a drive mechanism, which may include an escapement, e.g., resembling a piano hammer-action mechanism. A system which plays an open/closed hi-hat is disclosed, as well as a system which plays a rim shot.

20 Claims, 20 Drawing Sheets

HAMMER-ACTION NOT TO SCALE
195
212
245
240
231
233
230
235
285
283
273
270
280
260
220
225
250
200
206
214
209
210
307
290
276
300
305

DIMENSION 340
270
280
292
290
250
214
PEDAL REMOVED TO SHOW OVERHEAD VIEW OF SWING ARM/ MOUNT
VII
240
230
210
206
220
250
214
204
PIANO HAMMER ACTION

FIG. 27
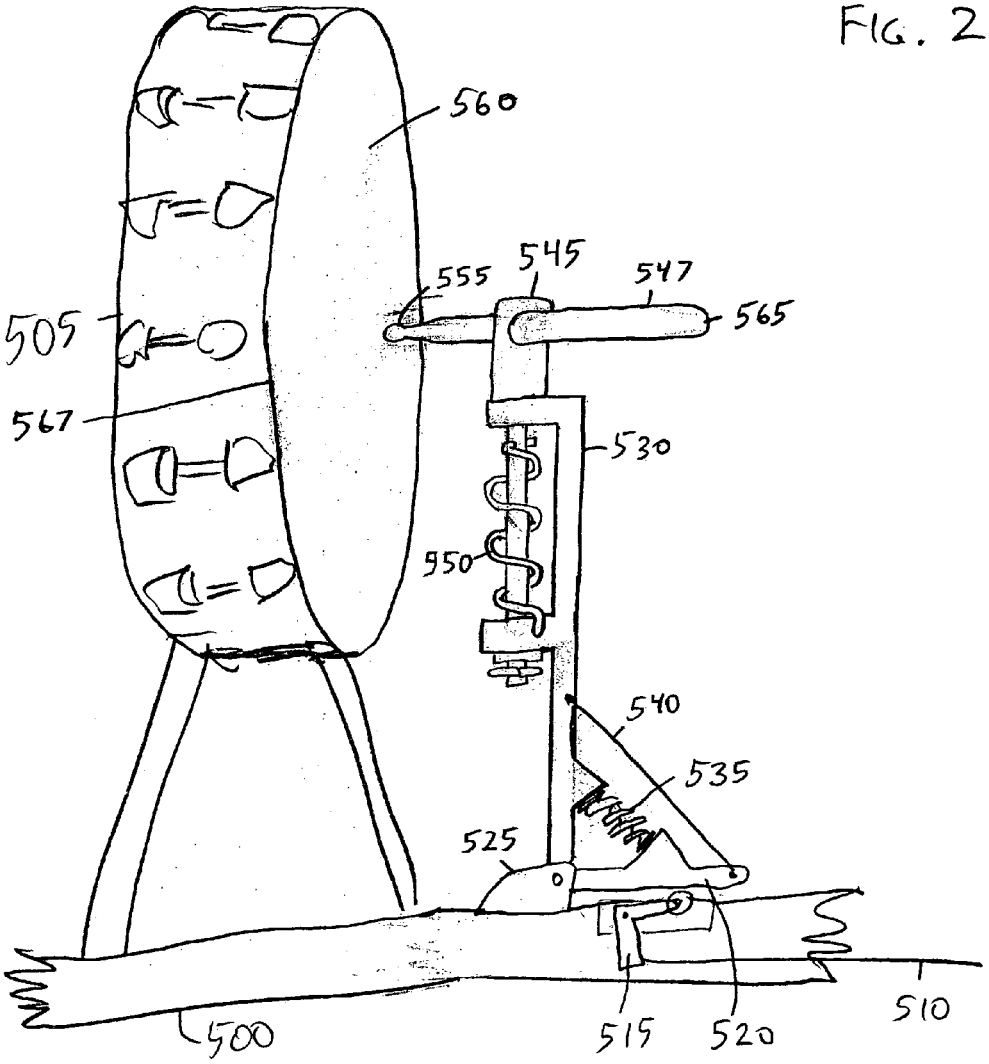
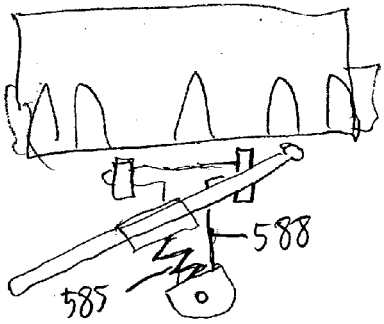
FIG. 29
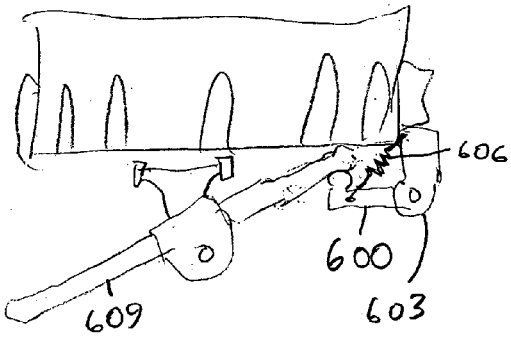
FIG. 30

FIG. 33
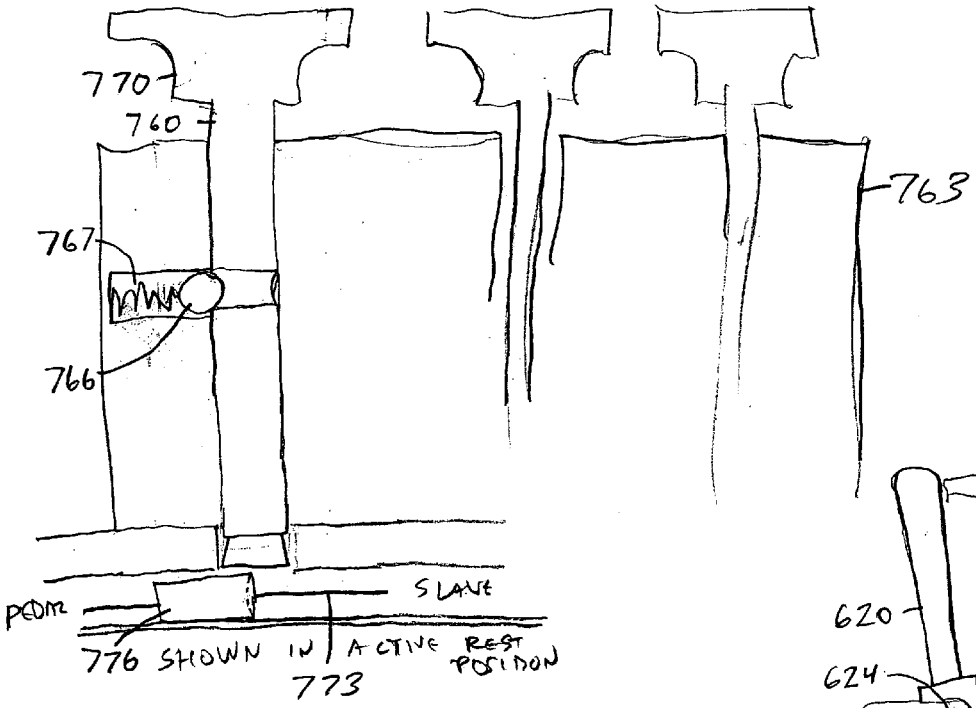
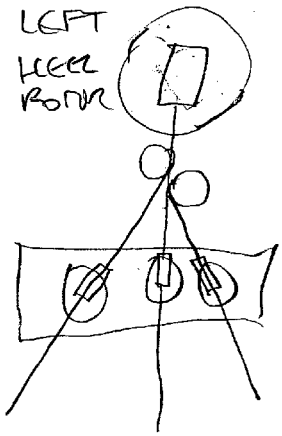
FIG. 34
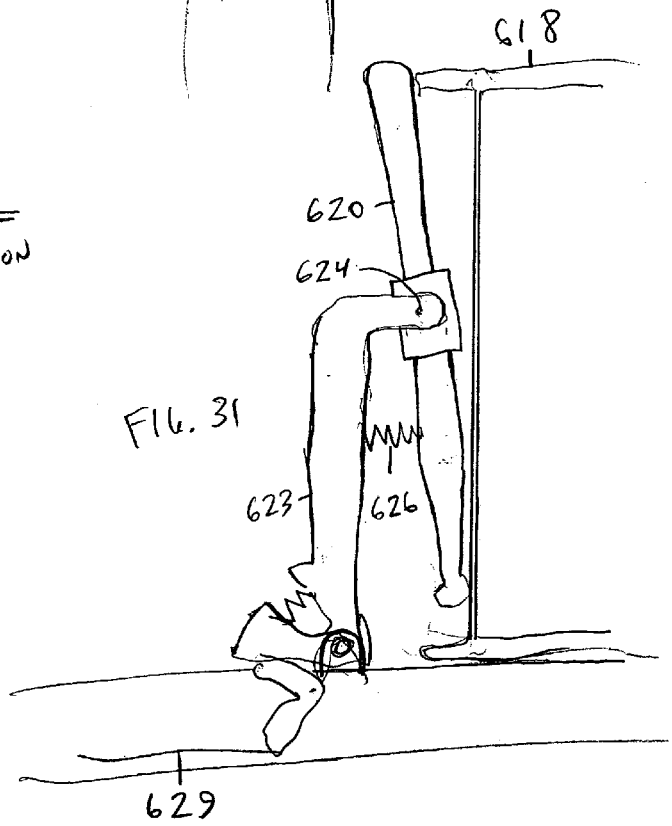
FIG. 31

SYSTEM FOR PLAYING PERCUSSION INSTRUMENTS WITH FEET

CROSS-REFERENCE TO RELATED APPLICATIONS

This application claims the benefit of provisional patent application Ser. No. 60/489,033, filed Jul. 22, 2003 by the present inventor.

FEDERALLY SPONSORED RESEARCH

Not applicable

SEQUENCE LISTING OR PROGRAM

Not applicable

BACKGROUND OF THE INVENTION

1. Field of the Invention

This invention provides means for a musician to play percussion instruments, e.g., drums and/or cymbals with his/her feet.

2. Prior Art

A musician who plays an instrument such as keyboard or guitar can enhance his/her performance by simultaneously playing a percussion instrument. For example, the foot-pedal of a standard hi-hat can be depressed on the two & four beats of each measure. A standard bass drum with standard foot-pedal can also be played.

To provide a wider variety of drum sounds, including cymbals, a system of electronic drums can also be used. In this system, foot switches (e.g. the Boss FS-5U Footswitch made by Roland Corp.) may be used to trigger digitally-recorded samples of drum sounds from an electronic drum machine. While good musical results may be obtained from this system, experience has found that audience members often lack the attention, sophistication, and insight to realize that the musician is triggering live drum sounds during performance. A good drum performance of this type sounds almost indistinguishable from a standard self-operating drum machine. With no actual drums to see, audience members tend to incorrectly assume that a drum machine is setting the music's tempo and triggering the drums sounds, even when the musician is actually creating the entire musical performance live. Hence, a live musical performance which may embody great coordination and skill is not fully appreciated by the audience. Another disadvantage of this electronic system is that simple footswitches cannot sense the downward velocity of the musician's foot. Hence, all drum beats have the same volume. Off-the-shelf methods of velocity sensing (such as those used on standard electronic musical keyboards) may be used to solve this problem, but these methods would require electromechanical engineering time, and the audience-perception problem discussed above would still remain.

It is possible to arrange drums/cymbals on the floor in front of a seated musician. A drum stick may then be attached to the musician's shoe(s), and the musician may then strike the drums/cymbals with the drumstick. However, this method has several disadvantages: Drums set on the floor will require a great deal of space, both horizontally and vertically. Hence, the musician will have to position his/her stool at a high level above the floor. If the musician is playing a standard acoustic piano, the piano itself may have to be elevated to accommodate the drums. The horizontal expanse of the drums/cymbals requires the musician to move his feet over large distances to reach different percussion instruments, making performance more clumsy and difficult. Also, a desirable drum beat sound generally requires that the drum stick, or beater, must freely bounce away from the percussion instrument after making contact. To manually achieve this action continuously with foot-mounted implements is difficult. Even a standard bass-drum/pedal requires that the musician must learn to release downward pressure on the pedal after the beater has made contact with the drum head, in order to produce a clean-sounding beat. This technique is aided somewhat in a standard bass drum arrangement because a standard bass drum beater has enough mass, and typically travels with enough velocity that it can impart a significant upward force on the musician's foot during the return bounce. But if one replaces the bass drum with a standard snare drum, and replaces the standard bass-drum beater with a drumstick, then the upward pedal force is reduced and a clean strike becomes more difficult. Also, this arrangement may result in a punctured snare drum head.

The manual-release requirement of a standard drum pedal is even more of a problem if the musician wishes to play one pedal with his/her toe and another pedal (playing a different instrument) with his/her heel. In this situation, there is a natural desire to rest the heel when playing the toe and vice versa. To perform a clean strike/bounce-away (to produce a satisfying ring and decay of the drum) with a standard drum pedal and then rest the beater against the drum head without producing a second audible strike is extremely difficult. Furthermore, it is impossible to play the other pedal with the first pedal resting in down position before the first strike has completely decayed, since holding the pedal down will cause the beater to press against the drum head, muting the ring.

British patent 185,227 (Davies), FIG. 12, discloses a striking device 116 which is driven by downward movement of a roller 112 attached to an arm 106. After the pedal 10 has reached its lower limit of travel, momentum of the striking device causes it to strike and rebound away from the drum 117. Several drawbacks are found with this arrangement:

(a) As the striking device is halted by downward roller pressure following a drum strike, an upward impulse, or "bump" is felt by the musician's foot. This impulse is distracting and irrelevant to the musical rhythm of the performance.

(b) The drum strike occurs after the pedal has reached its lower limit of travel. This detracts from the joy of playing since the event of the musician's foot hitting bottom does not correspond temporally with the event of the musician hearing the drum beat. It is preferable for the two events to occur simultaneously.

(c) The arm is, of necessity, rigid; and therefore heavy. Also, the arm takes up vertical space for the entirety of its length. Hence, a great engineering challenge is presented if it is desired to have two such arms crossing each other to play different percussion instruments without multiplying the vertical height of the base structure 7.

(d) The base structure 7 as shown takes up a great deal of vertical space, thus making it difficult to use when playing a piano.

(e) The apparatus as shown uses many different parts for linking pedals with strikers. Hence, tooling for manufacture is expensive.

U.S. Pat. No. 3,747,464 (Russell) discloses a pedal-to-striker linkage using a bicycle-brake-type cable system. Running a cable through a curved conduit presents significant friction and wear.

Swiss patent 98,101 (Grilli), FIG. 3, discloses a rotor with a cable-pulling point located above the rotational axis. The rotor is mounted between two parallel horizontal sheets. Like Davies, the structure takes up a great deal of vertical space.

There exists a need for a method of playing non-electronic percussion instruments by foot which is versatile (can be used for many different percussion instruments), comfortable for the musician, easy to master, and uses physical space efficiently.

Glossary

Percussion instrument: Any of various musical instruments which are played by being struck, e.g., a snare, bass or tom drum, a cymbal, a cowbell. etc.

Percussion instrument manipulation device: A mechanical device which plays a percussion instrument and/or changes the sound of a percussion instrument.

Striking Device: A mechanical object which strikes a percussion instrument, e.g., a drumstick, mallet, bass drum beater, wire brush or Blastick®.

Escapement: A mechanism (e.g., a piano hammer action) including an input member (e.g., a wippen) which moves from a rest position to an end-of-travel position, and an output member, (i.e., a striking device) (e.g., a hammer shank & hammer head), wherein, as the input member travels from its rest position to its end-of-travel position, motion is transferred from the input member to the output member as the input member travels from the rest position to a predetermined release position between the rest and end-of-travel positions, and as the input member travels between the release position and the end-of-travel position, the output member is not propelled by the input member, and is free to bounce off an object (e.g., a piano string or drum head) and reverse its direction of travel, even as the input member continues to travel toward its end-of-travel position. An escapement mechanism may include a backcheck for catching the output member after it has struck and bounced away from the instrument. Thus, the output member is prevented from bouncing back toward the instrument. An escapement mechanism may also include a jack (as in a piano action) which is driven by the input member to propel the output member toward the instrument, and a letoff device (e.g., a letoff button) to disengage the jack from propelling the striking device during a continuous downward pedal movement shortly before the striking device strikes the instrument.

Line: An elongate structure which is used to pull an object in the same direction as its length, e.g., a cable, wire, string, or a tracker rod (such as found in old-style pipe organs).

Rim Shot: A "side stick" beat played on a drum, typically a snare drum. A rim shot is typically played by holding the drumstick near the center of its length over the head, continuously pressing the tip of the drumstick against the head, accelerating the butt end of the stick toward the rim, and striking the rim. This type of beat is often used in bossa-nova patterns or in light rock styles when a soft mood is desired. NOTE: A "rim shot" in this specification and claims is not to be confused with a drum beat in which the stick is held at or near its butt end, and the entire stick is accelerated toward the drum in such a manner that the side of the stick strikes the rim at the same instant that the tip strikes the head.

SUMMARY OF THE INVENTION

Accordingly, a system is provided which includes a multiplicity of percussion instruments each manipulated by a corresponding percussion instrument manipulation device. Each instrument and its manipulation device is mounted on a horizontally-disposed rigid sheet base member, such as a piece of plywood. Also mounted on the base member are a multiplicity of motion transfer systems, respectively corresponding with the percussion instrument manipulation devices. Each motion transfer system includes a master rotor and slave rotor, each pivotally attached to the base member on a horizontal rotational axis, and a foot pedal which drives the master rotor. Each rotor includes a drive contact point and a line contact point. For the each rotor, the drive contact point is a point on the rotor horizontally displaced from the rotor's rotational axis and each line contact point is a point on the rotor below the rotor's rotational axis. The pedal applies downward pressure to the master rotor's drive contact point, thus causing the rotor to rotate. A line is provided, each line having a master end and a slave end. Each end is anchored to its corresponding rotor and extends horizontally away from its corresponding rotor's line contact point in a direction substantially perpendicular to the rotor's axis of rotation. Master rotor rotation resulting from downward pedal movement pulls on the line, moving the line along its axis. This line movement causes rotation of the slave rotor. This slave rotor rotation results in vertical movement of the slave rotor's drive contact point. This upward movement drives the corresponding percussion instrument manipulation device.

Each percussion instrument manipulation device which serves to strike an instrument includes an escapement as defined in the glossary.

A mechanism is provided for playing a rim shot beat on a drum. This mechanism includes a drumstick and a plurality of movement-transferring elements which transfer downward movement from a musician's foot to the drumstick These elements include a swingably-mounted swing arm disposed to swing toward the drum from a rest position to a strike position. The mechanism also includes a torque-applying device which is disposed to apply a torque to the drumstick relative to the swing arm. The drumstick is swingably connected to the swing arm. The drumstick is disposed to contact the rim of the drum as the drumstick end contacts the drum head when the swing arm is in its strike position. The torque-applying device maintains one end of the drumstick in contact with the drum head during a complete swing arm stroke from rest position to strike position.

A mechanism is provided for selectively playing two different sounds on a hi-hat. These sounds are a closed-hi-hat beat and an open-hi-hat beat. The closed-hi-hat beat is a short "tick" sound as heard when a conventional hi-hat is struck with foot pressure applied. The open-hi-hat beat may be a "tsss" sound produced by striking a partially open hi-hat, i.e., a hi-hat in which the two cymbals are in partial, or low-pressure contact with each other, as often heard on disco records. The mechanism includes a stationary cymbal and a moveable cymbal. The moveable cymbal is disposed substantially coaxially with the stationary cymbal and mounted to reciprocate between a first position (a closed position) and a second position (an open position). At least one striking device, e.g., a drumstick, is provided, swingably mounted to strike one of the cymbals. A first foot pedal is provided, linked to the striking device whereby downward movement of the first pedal causes the striking device to strike one of the cymbals. A second pedal is also provided which is linked to the moveable cymbal whereby downward movement of the second pedal from its rest position to its depressed position causes the moveable cymbal to move from its first position to its second position. The moveable cymbal exerts more pressure against the stationary cymbal when it is in its first position than when it is in its second position. Hence, when the first pedal is depressed as the second pedal is up, a closed-hi-hat beat is produced; and when the first pedal is depressed as the second pedal is down, an open-hi-hat beat is produced.

DRAWINGS—FIGURES

FIG. 27 shows a side view of a drum and corresponding apparatus for playing a rim-shot.

FIG. 29 shows an overhead view of a drum and corresponding apparatus for playing a rim-shot.

FIG. 30 shows an overhead view of a drum and corresponding apparatus for playing a rim-shot.

FIG. 31 shows a side view of a drum and corresponding apparatus for playing a rim-shot.

FIG. 33 shows a side cutaway view of a percussion instrument selection device.

FIG. 34 shows an overhead view of the system of FIG. 33.

DETAILED DESCRIPTION

Numerous variations of the invention are possible.

Figure 1:
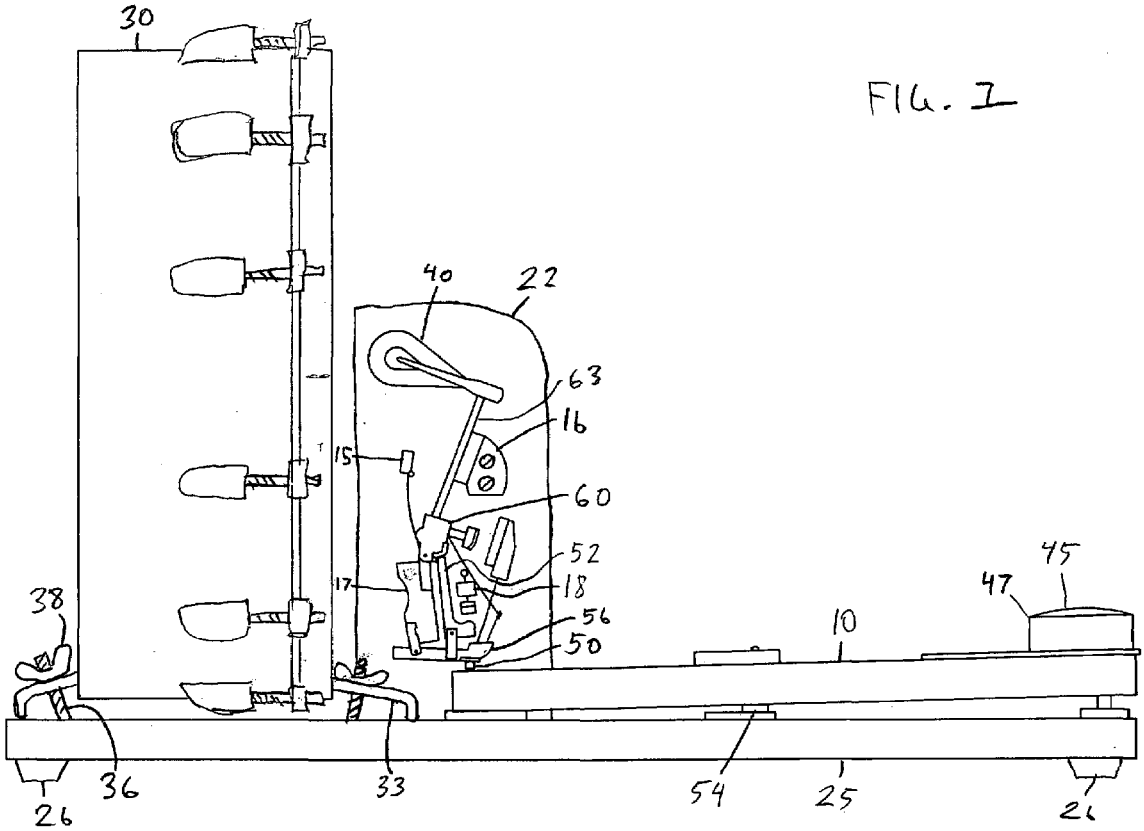
FIG. 1 shows a side view of a basic embodiment of the invention used to play a drum.

A simple and basic embodiment is shown in FIG. 1. A conventional upright piano key lever 10 and associated action are provided. A modified demonstration key/action, of the type often found in retail piano stores may be used. Note that the damper hardware is removed, since it is not needed. As in a demo unit, the spring rail 15, hammer rail 16, main action rail 17, and letoff rail 18 are mounted on a vertically-extending panel 22, which may be cut from ¾" plywood. Wood screws which fasten the hammer rail 16 to the panel 22 are shown in FIG. 1. The vertically-extending panel 22 is mounted on its bottom end to the top surface of a main base 25, which may also be made from ¾" plywood. The main base 25 lays flat on a carpeted floor or other horizontal surface. Rubber feet 26 may be provided to prevent the main base 25 from moving unintentionally. Also mounted on the main base 25 is a conventional drum 30. Mounting hardware for mounting the drum to the main base includes two metal brackets 33, two hanger bolts 36, and two wing nuts 38. Other percussion instrument mounting methods may be used. The hammer 40 strikes the head of the drum 30. A foot pad 45 is mounted on the top surface of the front end of the key lever 10. The top surface of the pad 45 may be convex, as shown, or may be flat and may be hard and smooth (recommended), or may incorporate a top surface material such as carpet, teflon, or rubber. The shape of the pad 45 as viewed from above may be square, rectangular, circular, or other. The underside of a musician's foot (not shown) strikes the foot pad 45, moving the key lever, and producing a drum beat. The pad 45 includes an inside edge 47 which, along with the convex top, provides tactile feedback to the musician. This feedback helps in orienting foot position in the front-rear dimension. All pad edges which are normally contacted by the foot during performance should be rounded to reduce shoe wear.

The musician may contact the pad 45 with his/her heel, toe, or any other portion of the underside of the foot. Hard-soled shoes are recommended, but not required. The musician my be standing or seated. The musician may, while playing the instrument be facing in any horizontal direction. For example, he/she may face toward the drum, away from the drum, or the drum may be disposed to his/her side. If the invention is to be used during a live performance, it is recommended that the various elements be disposed so that the musician's feet and the striking device, e.g., hammer 40 are visible to the audience. If the musician is on a stage facing the audience, then it is recommended that the action and percussion instrument be more-or-less under the musician's torso. This way, the drum does not block the view of the feet and striking device.

Numerous variations of this basic embodiment are possible. The key lever may be mounted to extend in any horizontal direction radiating from the capstan screw 50. For example, the key lever may extend under the drum, so that the action and foot pad 45 are on opposite sides of the drum. Any percussion instrument may be used instead of the drum 30. A grand piano action (not shown) may be used underneath a percussion device instead of the upright action configuration shown in FIG. 1. An advantage of the upright action configuration may be that the striking device is more visible to the audience.

It is recommended that the action mechanism and lever 10 be re-engineered to withstand more accelerative force than is normally carried by a conventional piano action. Material which is more robust than wood is recommended, for example, aluminum or acetal. The top end of the jack 52 may incorporate a roller (not shown) with a rotational axis parallel to the action flange center pins. The roller would thus roll against the underside of the hammer butt, reducing wear and friction. Other escapement means may be employed alternately. It is recommended that the conventional felt/centerpin bearings in the action be replaced by bearings having larger diameter axles. Ball bearings may be used. The lever's fulcrum 54 may also be re-engineered to be more robust and to withstand more side force than is normally applied to a conventional piano key. Also, the structure of the main base 25 and the panel 22 must be sufficiently sturdy so that a large weight may be applied to the pad 45 without causing the wippen 56 to move too far upward, damaging the action mechanism. The re-engineered action mechanism may be significantly larger in all dimensions than the conventional action.

Other striking devices (see glossary) may be used instead of the hammer 40. The hammer butt 60 may be modified so that different striking devices may be easily selected. This versatility may be essential, depending on the type of musical performance. For example, a musician may want to use brushes on a snare drum during the early part of a performance, then play the same snare drum with a nylon-tipped drum stick an hour later. Several methods may be employed to achieve easy striking device selection. For example, the hammer shank 63 may be replaced with a post (not shown) incorporating a mechanism with a sliding sleeve and steel balls similar to the mechanism used by ¼" F High-Flo (SM) Universal Quick-Connect compressed air hose couplers. Numerous striking devices may be fitted with corresponding hardware whereby they can thus be easily attached to or removed from the post. Other methods of easily attaching/detaching striking devices may be employed alternately, such as screws and threads, or cylinders/tubes with spring latches. Another method to achieve easy striking device selection incorporates a turret (not shown) mounted on the hammer butt. The turret rotates relative to the hammer butt on an axis perpendicular to the horizontal axis of hammer butt rotation, e.g., along the centerline of the removed hammer shank. Various striking devices are permanently attached to the turret, which can be rotated by the musician between songs to place a selected striking device in position to strike the percussion instrument. Another option is to use a conventional drumstick tip when maximum or normal volume is desired; and to slip a rubber or felt closed-end sleeve over the drumstick tip when the performance environment/situation calls for a softer sound.

A hi-hat mounted in continuously closed position may easily be used as a percussion device for the configuration shown in FIG. 1. One needs simply to mount a pair of hit-hat cymbals with the support shaft extending horizontally so the hammer 40 strikes the spherical (or conical) surface of one of the cymbals. However, the musician may desire to achieve the "tssss" sound of a slightly open hi-hat, perhaps to perform a disco song. Conventionally, an entire foot (e.g., the musician's left foot) is dedicated to the task of modulating pressure between the two hi-hat cymbals. One could engineer a means whereby a foot pedal, perhaps with a cable linkage, could modulate pressure between cymbals in the FIG. 1 configuration as described above. One foot could modulate pressure, and the other could strike the pad 45. However, the musician may want to be able to play other instruments at the same time, such as a bass or snare drum. Hence, it would be desirable to be able to produce a "tssss" sound with a single strike of a single foot pad. A simple way to achieve this function would be to mount the two hi-hat cymbals with moderate pressure between them. Thus, a strike would cause a "tssss" sound which would naturally decay after a given time, e.g., one half of a second, depending on how tightly the two cymbals are pressing against each other. This arrangement may be satisfactory. However, a musician may want to be able to mute the "tssss" sound before its natural decay has occurred, to provide the music with an additional rhythmic element. To achieve this function using a single control surface (a single footpad), a system may be engineered by which a musician can initiate a strike on a semi-opened hi-hat with a single press of a footpad, and then allow the "tsss" sound to sustain until it naturally decays, or until the foot is released from the pad, whichever comes first.

Figure 2:
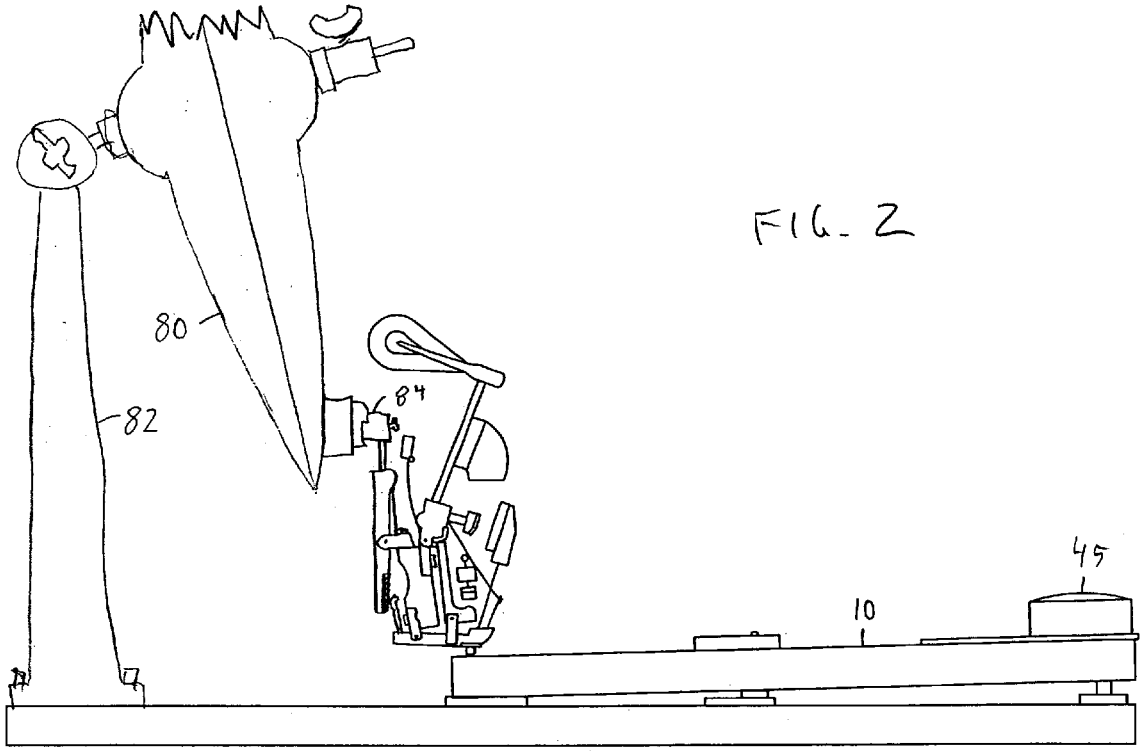
FIG. 2 shows a side view of a basic embodiment of the invention used to play a hi-hat.

To achieve this function, the conventional damper mechanism may be restored to the piano action of FIG. 1 as shown in FIG. 2. A pair of hi-hat cymbals 80 are supported by a stand 82. The piano action damper 84 rests against one of the cymbals when the pad 45 is at rest and is released from the cymbal when the pad is depressed. As with other aspects of the action, the damper mechanism may be modified to make it more robust and, perhaps to increase the amount of force applied to the cymbal, since a standard piano action damper spring may not provide sufficient force to quickly mute the cymbals. The cymbal-contacting surface area of the damper felt may also be increased.

Figure 3:
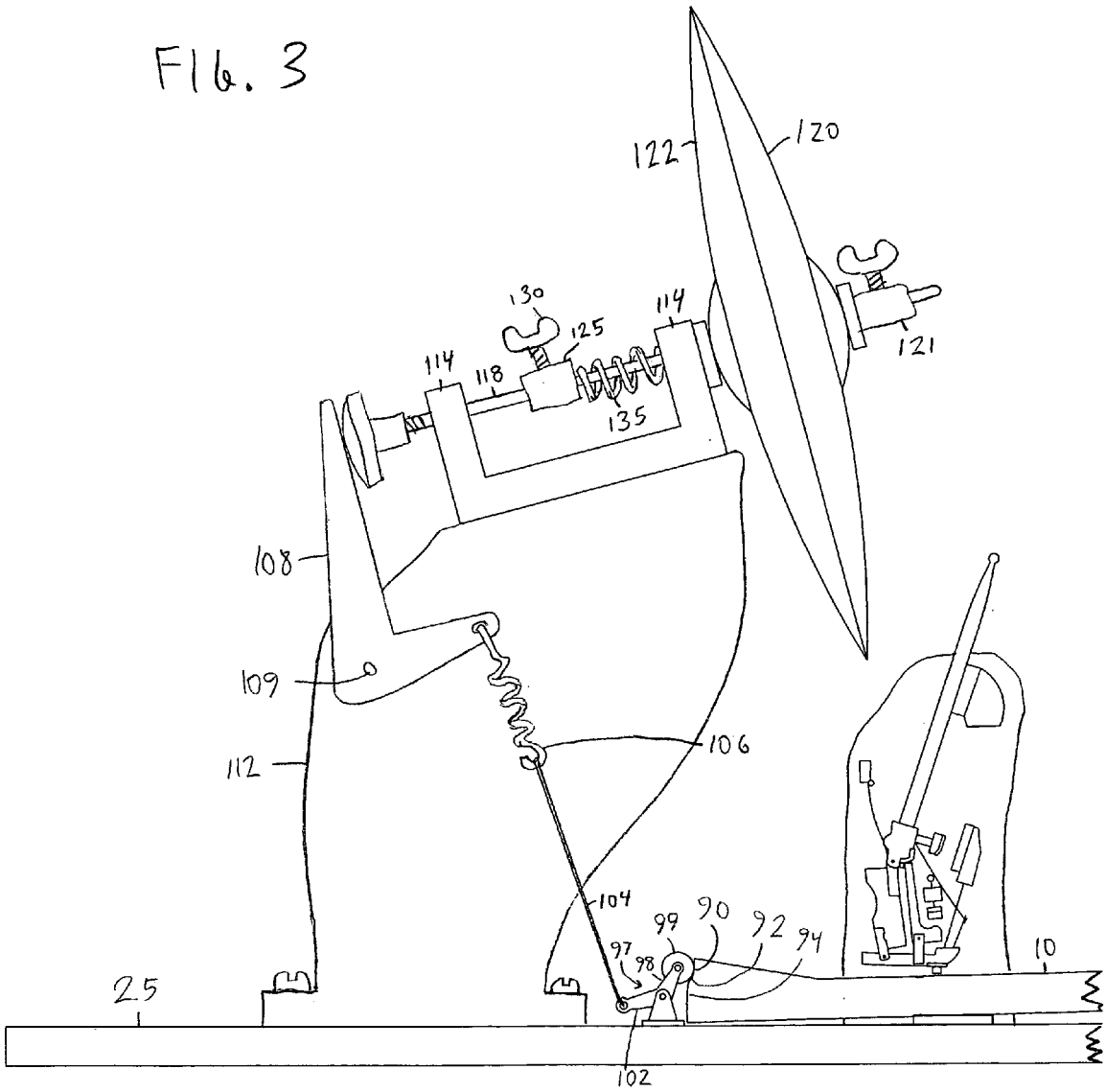
FIG. 3 shows a side view of the action and hi-hat structure of an alternate embodiment of the FIG. 2 apparatus.

In the event that the FIG. 2 design does not provide the desired muting sound, a mechanism may be devised which decreases the relative pressure between the pair of cymbals as the pad 45 is depressed and increases the pressure as the pad is released. One such mechanism is shown in FIG. 3. In this design, the rear section of the key lever 10 is extended further to the rear as shown. The cross-sectional shape of the rear end of this lever includes an indent portion 90, an incline portion 92, and a plateau portion 94. A rotor 97 is provided, swingably mounted behind the lever 10. Rotor 97 includes a front arm 98 at the end of which is mounted a roller 99 which rolls over the three aforementioned lever end portions as the lever 10 is depressed. Rotor 97 also includes a rear arm 102 at the end of which is anchored the lower end of a cable 104. The upper end of cable 104 is attached to the lower end of an extension spring 106. The upper end of spring 106 is anchored to an upper lever 108. Upper lever 108 is swingably mounted via an axle 109 to a stationary vertical support structure 112, which is mounted on the main base 25. Hence, depression of the pad 45 (not shown in FIG. 3) causes rotor 97 to rotate counterclockwise and upper lever 108 to rotate clockwise. Support structure 112 includes a pair of forks 114 which support a cymbal support shaft 118 which can slide along its axis through two bushings (not shown), one bushing in each fork 114. A front (top) hi-hat cymbal 120 is mounted on a clutch 121 on the front end of shaft 118. A rear (bottom) hi-hat cymbal 122 rests on shaft 118 via a bushing through which shaft 118 can slide. A center cylinder 125 is clamped to shaft 118 between the forks 114 with a wing nut 130. A compression spring 135 applies rearward pressure to cylinder 125, thereby applying relative pressure to the two cymbals when the pad 45 (not shown in FIG. 3) is at rest. Clockwise rotation of upper lever 108 causes forward movement of front cymbal 120, reducing relative pressure between the two cymbals. Roller 99 contacts the indent portion 90 as the pad is at rest, and rolls up the incline portion 92 as the pad moves downward until the pad is near the end of its downward travel, at which time roller 99 contacts the plateau portion 94. Hence, rotor 97 only rotates during the middle portion of the pad's downward travel. Thus, roller 99 only presents resistance to downward pad 45 movement during the middle portion of the stroke. Thus, initial downward acceleration of the pad is unhindered by the cymbal-releasing mechanism, and the downward foot pressure required to keep the pad down as the "tsss" sound sustains is small, reducing the musician's muscle fatigue.

Numerous variations of the FIG. 3 mechanism are possible. Extension spring 106 can be placed nearer to rotor 97, and upper lever 108 can be replaced with a pulley (not shown). Cable 104 is placed around the upper right portion of this pulley (as viewed from the perspective of FIG. 3). The pulley transfers the downward force of the top end of the cable 104 approx. 90 degrees whereby the upper end of the cable pulls forward. The upper end (which is now the rear end) of cable 104 is then anchored directly to a sideways-projecting member (not shown) mounted to the rear end of shaft 118. Thus, the cable pulls directly on the rear end of the shaft 118.

Figure 4:
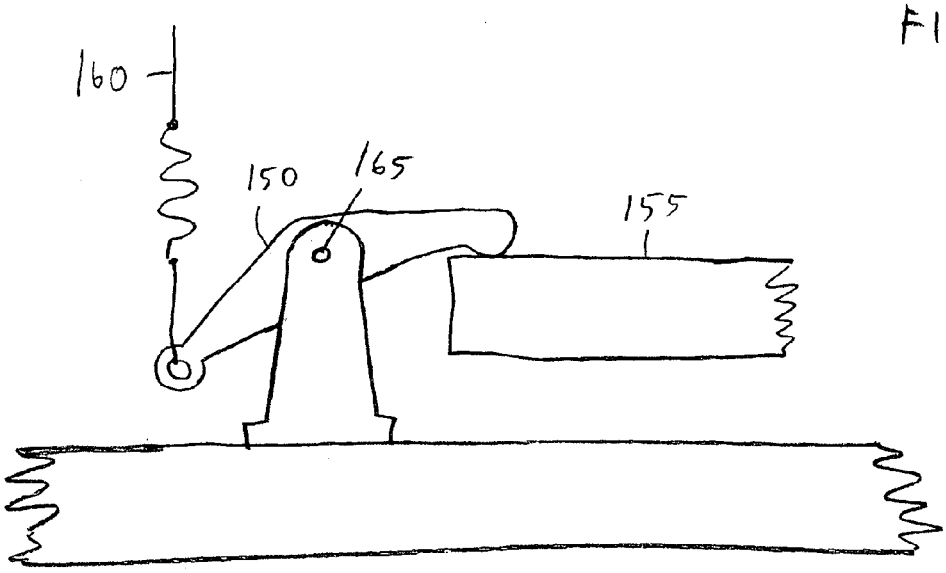
FIG. 4 shows a side view of an alternate embodiment of an element of the FIG. 3 apparatus.

FIG. 4 shows a variation of the FIG. 3 rotor 97. The FIG. 4 rotor 150 is rotated by the top surface of the rear end of the key lever 155. Note that the angle of the cable 160 is such that the rotor 150 has more leverage on the cable as the pad 45 (not shown in FIG. 4) is depressed. This mechanism can be engineered so that the cable 160 is nearly aligned (in the front-rear direction) with the rotor axle 165 when the pad is fully depressed. Hence, the rotor applies little or no downward force to the back of the lever 155 when the pad is fully depressed. This characteristic is desirable as set forth above.

Again, it should be emphasized that many alternate hi-hat opening linkages are possible. A mechanism to open the cymbals may be operated from the wippen. Another configuration, not shown, places the hi-hat cymbals in the standard horizontal configuration on a modified standard hi-hat stand. A grand piano action is placed on a platform under the lower cymbal. The key lever 10 operates the piano action via a vertical strut. The rear end of the lever also lifts the vertical shaft which holds the upper cymbal.

Alternately, a switch may be provided which closes when the pad 45 is depressed. This switch operates a solenoid which opens the cymbals. An advantage to this method is that the switch may apply little or no resistance to downward movement of the pad.

Figure 5:
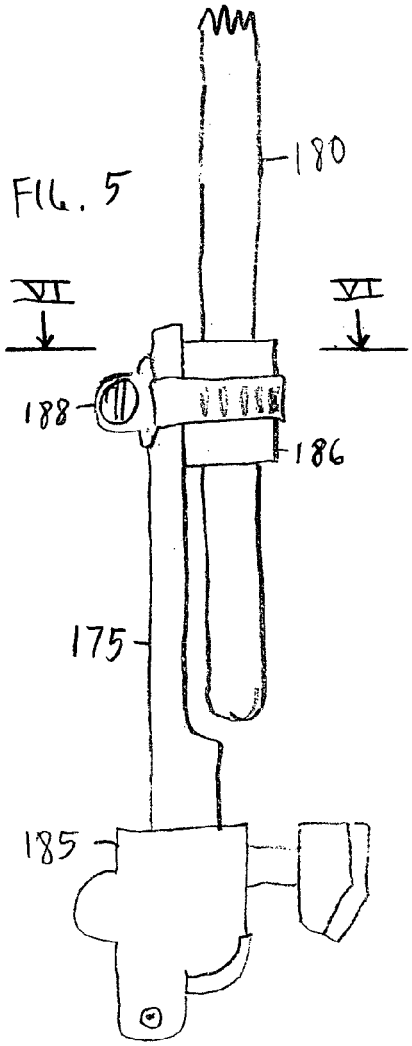
FIG. 5 shows a side view of a drumstick-holding apparatus.
Figure 6:
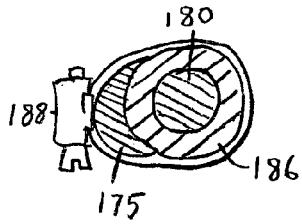
FIG. 6 shows a cross-sectional view of the apparatus of FIG. 5 taken along line VI.

FIGS. 5 & 6 show an alternate method of attaching a drumstick 180 to the hammer butt 185. A post 175 is attached to the hammer butt 185. Post 175 has an accurate upper cross section as shown in the cut-away view of FIG. 6. A rubber sleeve 186 is wrapped around a section of the drumstick approximately one-third of the distance from the bottom end to the striking tip. A hose clamp 188 is used to secure the sleeve/drumstick to the post. The purpose of this structure is to allow the drumstick to vibrate naturally after hitting the cymbal. Without this structure, the natural vibration of the drumstick might tend to cause the drumstick to disengage from the hammer butt over time. Other structures which serve this purpose can be engineered alternately.

Other types of escapement actions can be used instead of standard upright or standard grand piano actions. Many such prior art actions can be found in the patent literature under U.S. Classes 84/236–84/255.

Alternate Linkages:

Other types of linkages can be used to transfer motion horizontally/vertically from the pad 45 to the striking device.

Figure 7:
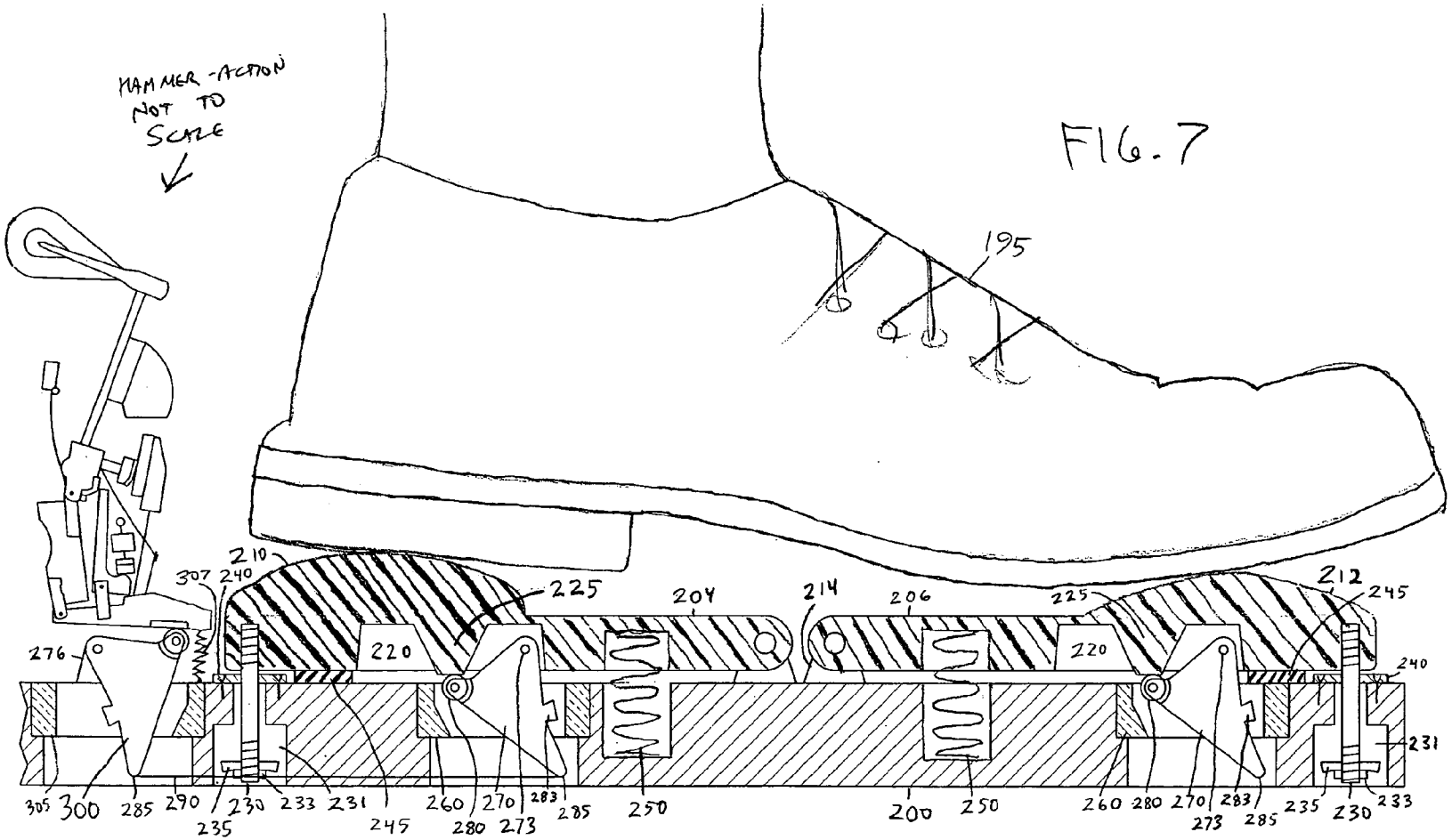
FIG. 7 is a cross-sectional side view of a pedals and linkage mechanism.
Figure 8:
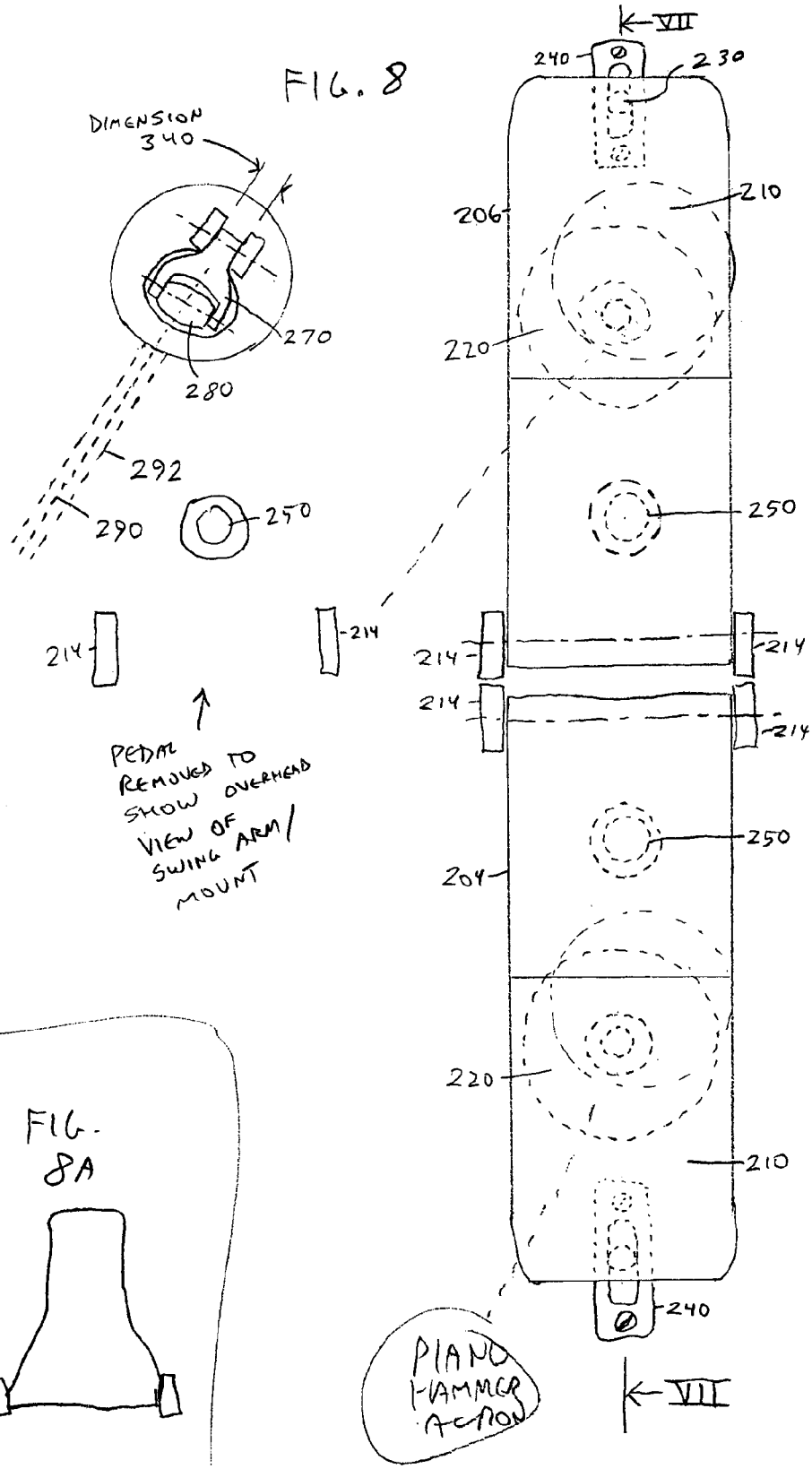
FIG. 8 is an overhead view of the FIG. 7 mechanism.

One such linkage uses a flexible cable made from braided Dacron®, plastic-coated steel, or other material. FIG. 8 is an overhead view of two pedals 204 & 206 using such a linkage. FIG. 7 shows a cross-sectional view of the same pedals and their linkage mechanism taken along line VII as shown in FIG. 8. A shoe 195 worn by a human foot is shown depressing both pedals simultaneously in FIG. 7. Referring now to these two drawings, a stationary base plate 200 is provided, made from 1.9 cm-thick plywood, particle board, or other material. Mounted on top of the base plate are a heel pedal 204 and a toe pedal 206, each pedal including foot-contacting pads 210 & 212, respectively. The top surface of heel pad 210 is shaped as a section of a cylinder as seen in cross-section in FIG. 7. The center axis of the cylinder section is horizontal and parallel to the axis of pedal movement. Hence, the heel of the shoe 195 can easily rock front-to-rear on the pad 210 and maintain a level left-right orientation. The top surface of toe pad 212 is shaped as a section of a sphere. Hence, the ball of the foot can sense easily sense the center of the pad 212 and maintain proper position. The rear pad 210 extends higher than the front pad 212 as shown to enhance foot comfort. The pedals may be made from acetal, aluminum, or other material. The pedals are swingably mounted on axle pylons 214 which are attached to the base plate 200.

The underside of each pedal includes a circular cavity 220 with a drive post 225 extending downward through the cavity's center.

Each pedal also includes a bolt which serves as a guide pin 230. These guide pins are anchored in the swinging ends of the pedals and move up and down with the pedals. These guide pins extend into guide pin cavities 231 in the base plate. At the bottom end of each guide pin is a nut 233 which holds a felt washer 235 in place. Two stationary bushings 240 are provided, one for each pedal. The bushings, made from acetal or other material, are attached to the base plate 200. Each guide pin passes through a slot in its bushing. Each guide pin serves two functions: (1) it limits left-right movement of the swinging end of its pedal as its slides against its bushing 240, and (2) it limits upward movement of its pedal as its felt bushing 235 touches the top surface of its cavity 231.

Downward pedal movement is limited by a closed-cell foam rubber pad 245 (see FIG. 7). When downward foot pressure on a pedal is released, its upward movement is aided by a compression coil spring 250.

Figure 9:
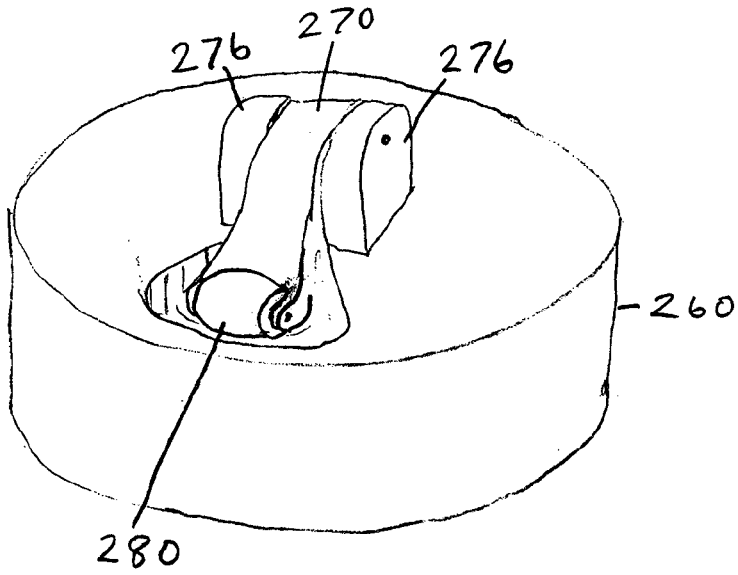
FIG. 9 shows a perspective view of a swing arm mount and swing arm.
Figure 10:
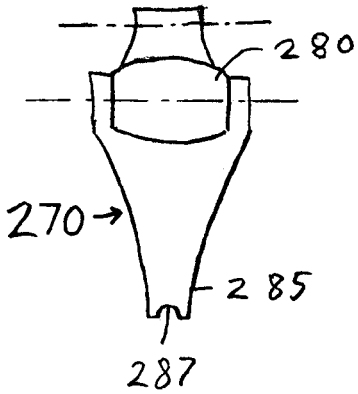
FIG. 10 shows a front view of a swing arm.

For each pedal, a swing arm mount 260 is provided. Each swing arm mount may be machined from cylindrical acetal stock, or other material and is inserted into a bore in the base plate 200 as shown in cross-sectional side view in FIG. 7. Means are provided (not shown) for preventing the swing arm mount from rotating in the bore. A swing arm 270 is swingably mounted on each swing arm mount. The rotational axis of the swing arm is horizontal. In the FIGS. 7–10 design, the swing arm's axle 273 is mounted on two axle posts 276. The pedal-contacting tip of each swing arm includes a roller 280 which is mounted on an axle with an axis parallel to the horizontal rotational axis of its swing arm. Each roller 280 may be made from aluminum, acetal, or other material and is formed with a curved lengthwise shape as shown in FIGS. 9 & 10. Each swing arm also includes a cable-anchoring post 283 and a cable-pulling tip 285 with a slot 287 as seen in FIG. 10.

A cable 290 is tied to the post 283 and wrapped downward to the cable-pulling tip 285 and through the slot 287. From the slot 287 the cable extends horizontally through a slot or channel 292 (shown with dotted lines in the upper-left area of FIG. 8) in the underside of the base plate 200 to the cable-pulling tip of an action-driving swing arm 300 which is located underneath the escapement action of the corresponding percussion instrument. To protect the cables, a sheet (not shown) of 1.5 mm plastic or rubber may be attached to the underside of the base plate 200 using attachment means which allow for easy detachment and re-attachment. Since each rotor's axle 273 is located above its cable-pulling tip 285, the cables may be located on the underside of the sheet 200. Thus, the cables can be easily accessed for servicing without removing the pedals. Each cable may include a turnbuckle or other means to precisely adjust the cable length.

The action-driving swing arm 300 and its mount 305 may be physically identical to the other swing arms/mounts. The swing arm underneath the foot-contacting pad may be referred to hereinafter as the "master" swing arm (the swing arm which pulls the cable when the pedal is depressed), and the swing arm underneath the action (the swing arm which is pulled by the cable when the pedal is depressed) may be referred to hereinafter as the "slave" swing arm.

When a pedal, e.g., pedal 204, is depressed as shown in FIG. 7, the drive post 225 pushes the roller 280 downward, rotating the swing arm 270, which pulls on the cable 290, which rotates the action-driving swing arm 300, which drives the action, which imparts a strike against the percussion instrument. An expansion spring 307 is provided to maintain tension on the cable 290 and to lift the pedal 204 when downward pressure is released by the musician's foot. Spring 307 is anchored to the wippen and to the action support structure. Thus, the action support structure can easily be removed from the base plate 200 without special attention paid to the spring. Alternately, a spring (not shown) may be incorporated into the slave mount/rotor structure to serve the same function as spring 307.

A clear acrylic shroud (not shown) around the action is recommended to protect the action from stray foot movement. Other materials can be used for the shroud, but it is recommended that the workings of the action be made visible to spectators, since this visual feature will enhance their entertainment experience. It is particularly important for the striking device to be visible as it strikes the percussion instrument.

Figure 36:
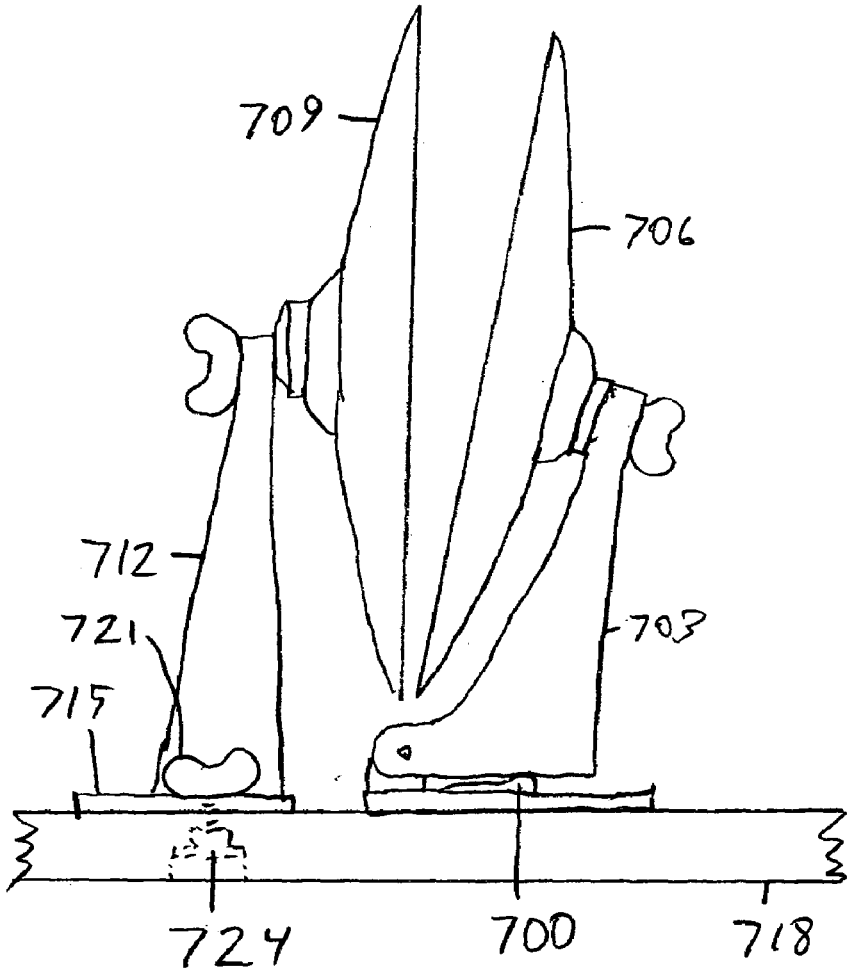
FIG. 36 shows a side view of a close-on-downstroke hi-hat mechanism.

The action and shroud may be secured to the base plate 200 by quick-release attachment means (not shown) such as wingnut-head machine screws attached to T-nuts installed in the base plate 200 or other hardware. The T-nuts may be inset as shown in FIG. 36 so that linkage cables may pass underneath. With similar hardware used for attaching the percussion instruments to the base plate 200, the base plate may assume a more-or-less flat shape for easy transport from one performance venue to the next. It is recommended that the pedals be left on the base plate during routine transport since they have a low vertical profile. A hard-shell carrying case (not shown) is recommended for the percussion instrument manipulation devices and the percussion instruments.

The master swing arm mounts 260 can be placed so that their swing arms pull their cables in any horizontal direction, as long as the roller 280 is placed directly under the post 225. Hence, the amount of cable movement (in linear units) resulting from pad depression will always be the same, regardless of which horizontal direction the cable extends toward.

Figure 18:
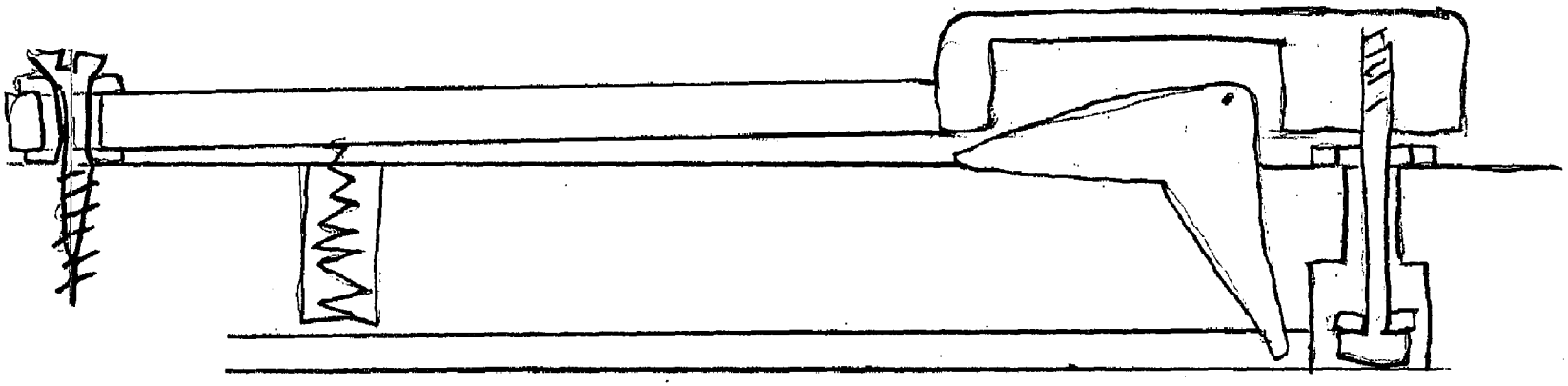
FIG. 18 is a cross-sectional view of pedal and rotor.

(Alternately, the post 225 can be eliminated, and the swing arm can be disposed so that the roller instead contacts the underside of the outer rim of the circular cavity as shown in FIG. 18. An advantage of this alternate design is that the swing arm can be designed with the roller disposed farther from the axle, reducing roller rotation. Or, the roller can be eliminated, as shown.)

Two cables and their respective base plate slots 292 can even cross each other. Thus, this design is very versatile in that various percussion instruments may be placed in numerous locations. The instruments may be placed on either side of the musician (or both sides of the musician) so the musician can face the audience and both his/her feet and the striking devices will be easily visible. The instruments can be placed in front of the musician with the striking devices placed on the opposite side of the instruments from the musician (so he/she can face the audience and they can see the striking devices strike the instruments). Pulleys can be used to enable the cable 290 to wrap around horizontal or vertical corners. Hence, percussion instruments and their actions can be placed on stands whereby the instruments can be disposed at the musician's shoulder level to increase visibility. A single pedal can simultaneously drive two slave swing arms and two striking devices, e.g., for a bass drum and a crash cymbal. This dual use can be achieved by tying a second cable to a first cable in a slot 292 in the underside of the base plate 200. A pulley (not shown) can be used to direct one of the cables away from the other cable and toward its own slave swing arm. Numerous other instrument placement options are possible.

Figure 11:
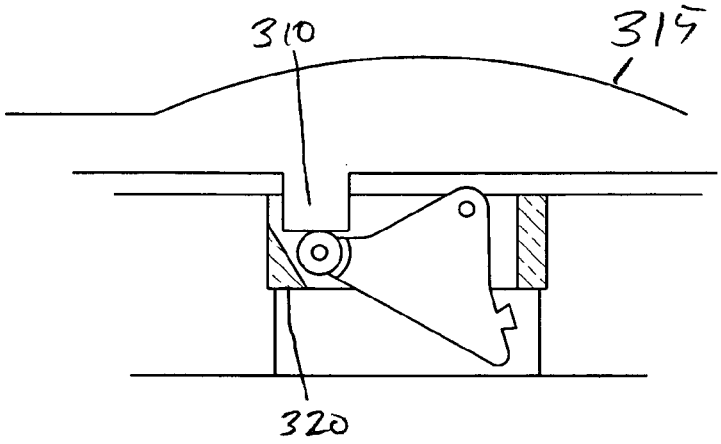
FIG. 11 is a cross-sectional view of a pedal and swing arm.
Figure 12:
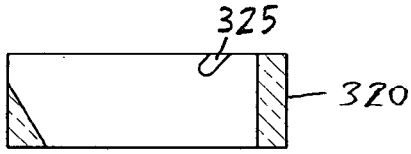
FIG. 12 is a cross-sectional view of the swing arm mount of FIG. 11.
Figure 13:
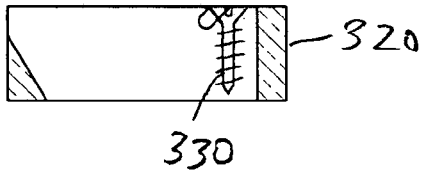
FIG. 13 is a cross-sectional view of the swing arm mount of FIG. 11 with an axle-retaining screw shown.

This design also has the advantage of a low profile—the pads 210 may be close to the floor. This advantage is particularly beneficial when the musician is playing a piano. A variation on this design which allows an even lower profile is shown in FIG. 11. Here the circular cavity 220 (shown in cross-section in FIG. 7 and with dotted lines in FIG. 8) is eliminated. The drive post 310 extends lower from the underside of the pedal 315 and lower into the swing arm mount 320. This mount includes a slot 325 (shown in cross-section in FIGS. 12 & 13) into which the two ends of the swing arm axle are placed. Two flathead machine screws 330 are provided (one is shown in FIG. 13) to ensure that the axle and swing arm do not come loose from the slot.

Figure 8A:
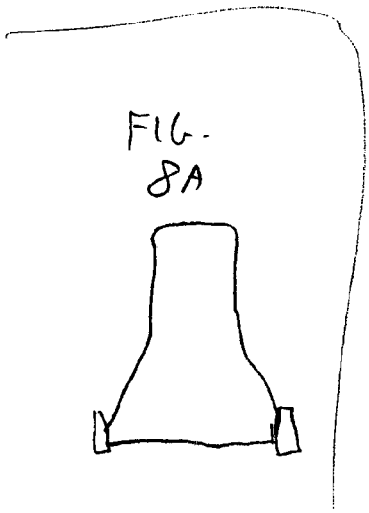
FIG. 8A is an overhead view of an alternate pedal shape.

Other variations on the design of FIGS. 7 & 8 are possible as well. The width (dimension 340, see FIG. 8) of the axle-engaging portion of the swing arm may be lengthened. Also, the distance between pedal axle pylons 214 may be lengthened as shown in FIG. 8A. With this wider-axle design, the bushing 240 may be unnecessary.

Figure 15:
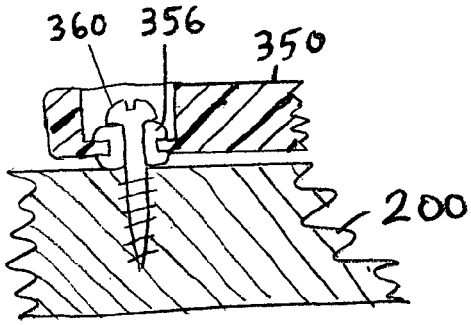
FIG. 15 is a cross-sectional view of a pivot mount for a pedal.
Figure 14:
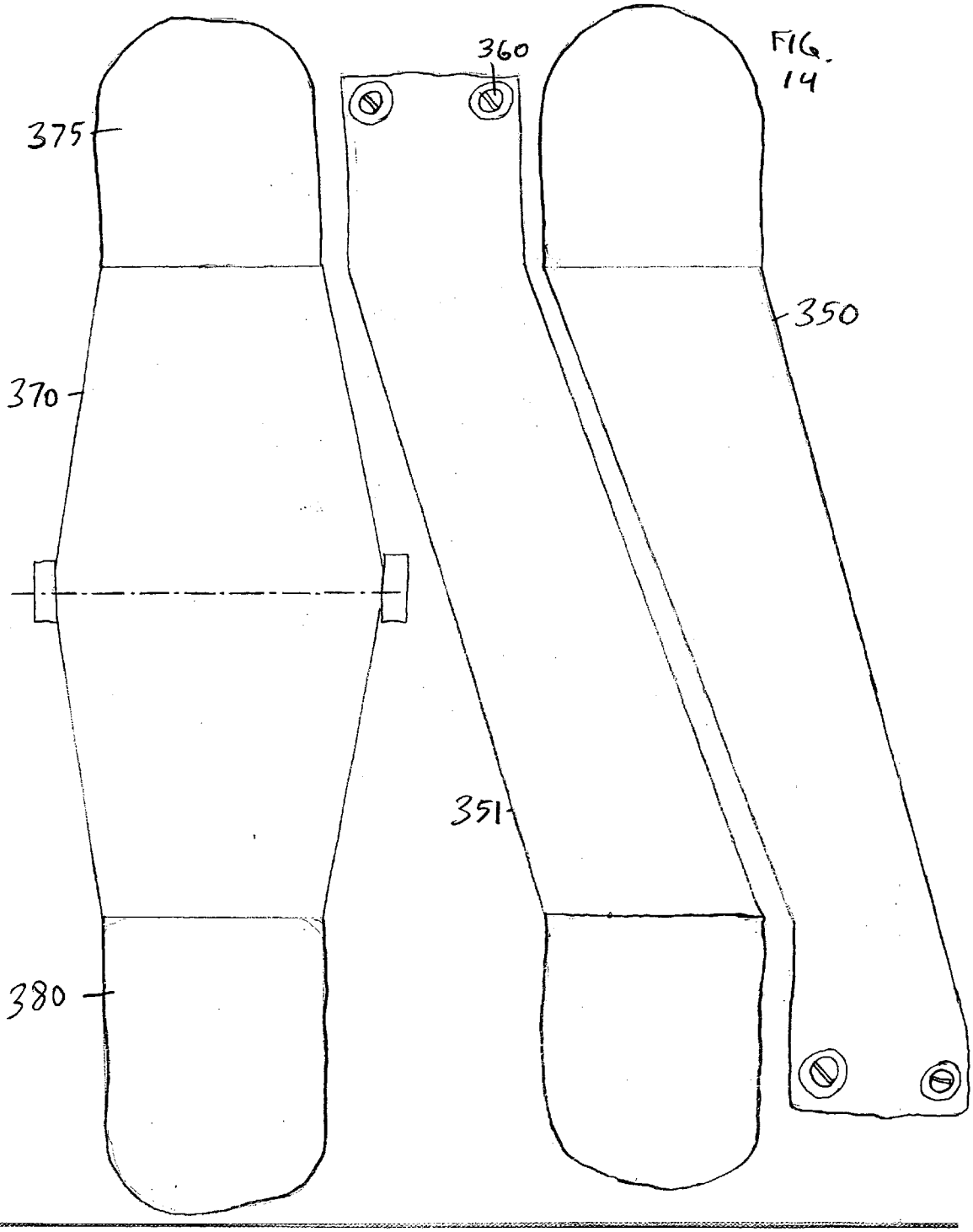
FIG. 14 is an overhead view of three pedals.

FIG. 14 shoes a variation on the pedal layout. The two pedals on the right 350, 351 have foot-contacting pads whose top surfaces are the same as those of FIGS. 7& 8 and are played the same way also. However, these pedals are longer as shown. This longer length allows for a more "straight down" pad movement. Pedals 350, 351 move through a smaller angle when depressed. Hence, a different fulcrum method is employed, shown in FIG. 14 and in cross-section in FIG. 15. Here a rubber grommet 356 is inserted into a bore in the pedal 350. A wood screw 360 holds the grommet, and thus the pedal, to the base plate 200.

FIG. 14 also shows a seesaw pedal 370 which includes a toe-contacting pad 375 and a heel-contacting pad 380. When one pad moves downward, the other moves upward, and vice versa. Two swing arms are provided (one under each pad as in FIG. 7), each pulling its own cable and driving its own action. Thus, the seesaw pedal causes one instrument strike when one pad is depressed, and another strike when the other pad is depressed. The seesaw pedal and its corresponding cable-driving hardware may be adjusted so that each wippen is halfway through its travel when the pedal is level, or may be adjusted so that each wippen is at the bottom of its travel when the pedal is level. With this latter configuration, the pedal comes to rest in a level position when the foot is lifted completely away. Then, the musician can drive either striking device though its entire stroke by depressing either pad. With both striking devices placed to strike the same instrument (e.g., a closed hi-hat), rapid multiple strikes can easily be performed with one foot. Alternately, the two slave swing arms can be positioned to drive the same escapement action (i.e., the same wippen). This consolidation reduces cost. To further reduce cost, the two cables from the seesaw pedal can be tied together within a slot 292 or cavity inside the base plate so that only one slave swing arm is required. One or more pulleys (not shown), mounted (with vertical axis') inside a cavity in the underside of the base plate can be used to direct the two cables to the location where they are tied together.

Figure 16:
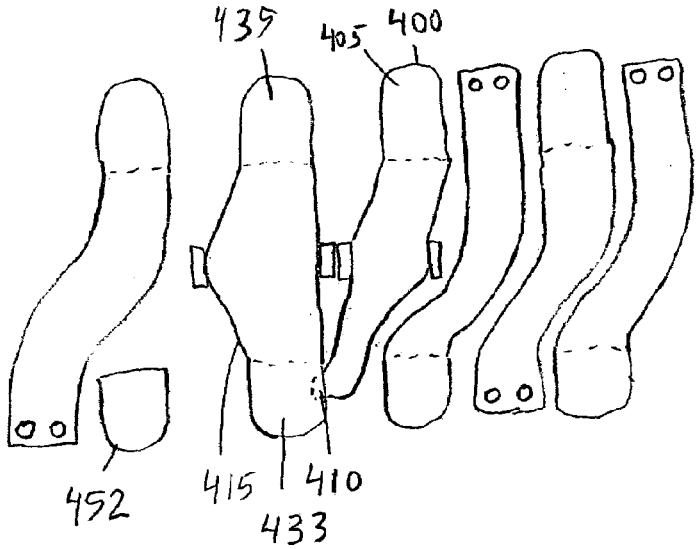
FIG. 16 is an overhead view of and arrangement of pedals.
Figure 17:
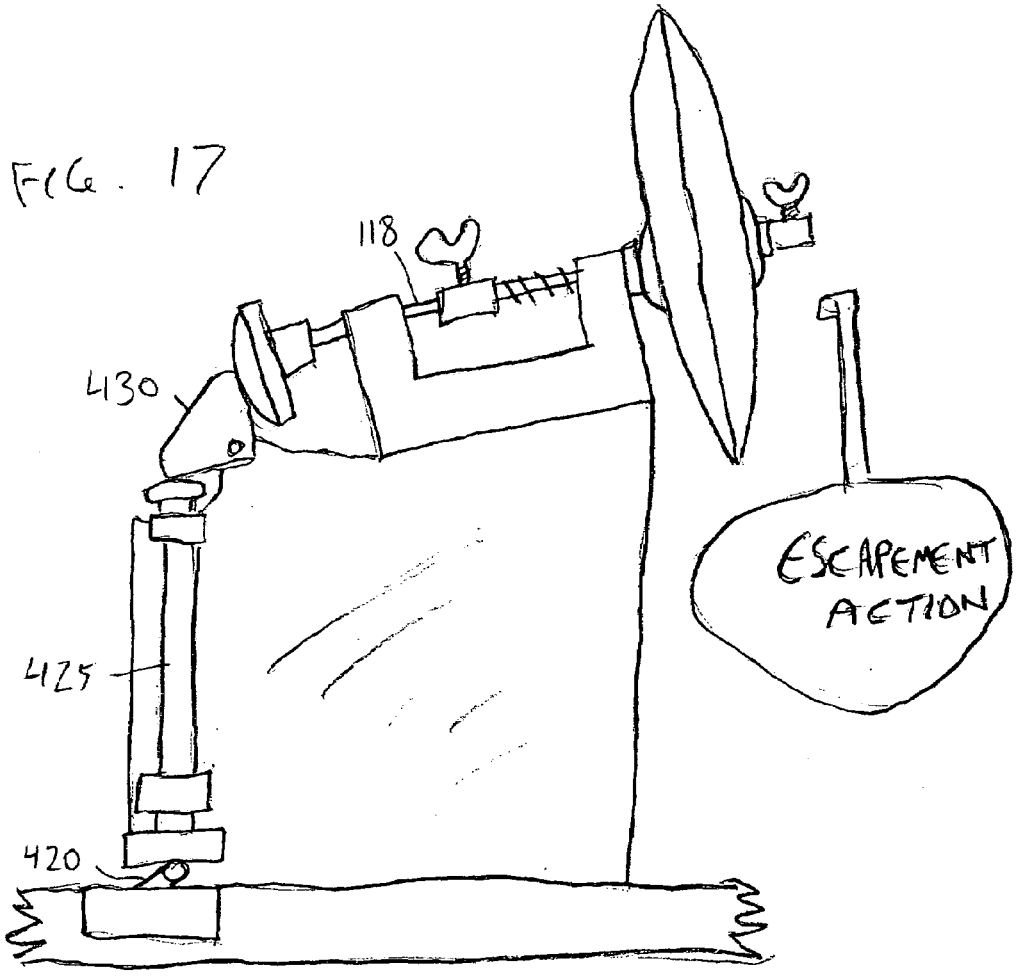
FIG. 17 is a side view of a hi-hat and corresponding opening/striking system.

FIG. 16 shows an arrangement of pedals which includes an open hi-hat pedal 400. This pedal is a seesaw type with only one foot-contacting pad 405 and one master swing arm located under the pad. At the other end of pedal 400 is a lifting tab 410 which extends underneath the heel pad of the adjacent seesaw pedal 415. This adjacent pedal 415 performs double-strikes on a hi-hat as discussed above. The cable from the master swing arm of the open hi-hat pedal 400, when pulled, operates a hi-hat-opening mechanism shown in FIG. 17. This mechanism includes a slave swing arm 420 which raises a pushrod 425 which rotates a rocker arm 430 which pushes a shaft 118 which reduces pressure between the hi-hat cymbals as described above. When the open hi-hat pedal pad 405 is depressed the tab 410 lifts the heel end 433 of the hi-hat pedal 415, depressing the toe end 435 of the pedal, causing a strike on the hi-hat. Thus, a foot strike on the open hi-hat pad 405 results in a strike on an open hi-hat. The hi-hat remains open until the pad 405 is released. The hi-hat pedal 415 can be rocked back and forth without causing depression of the open hi-hat pad 405, thus producing a series of closed hi-hat strikes. Performing a series of open/closed strikes with these pedals is easy and natural: The heel remains on the rear pad 433, and the toe alternates between the two toe pads, depending on which kind of hi-hat sound is desired. For disco songs, down-beats are performed with the heel. Alternately, the open hi-hat pad can be a heel pad with the other end of its pedal including a lifting tab which extends under the toe end. This alternate design has the advantage of mimicking the function of a standard hi-hat: The hi-hat is closed by a depression of the toe. Hence, a drummer will quickly learn to play these two pedals. As an alternative to a linking member (such as tab 410) the open hi-hat pedal may drive its own striking device and the hi-hat opening mechanism simultaneously. This dual function of one pedal can be accomplished with two slave rotors as discussed above.

Figure 32:
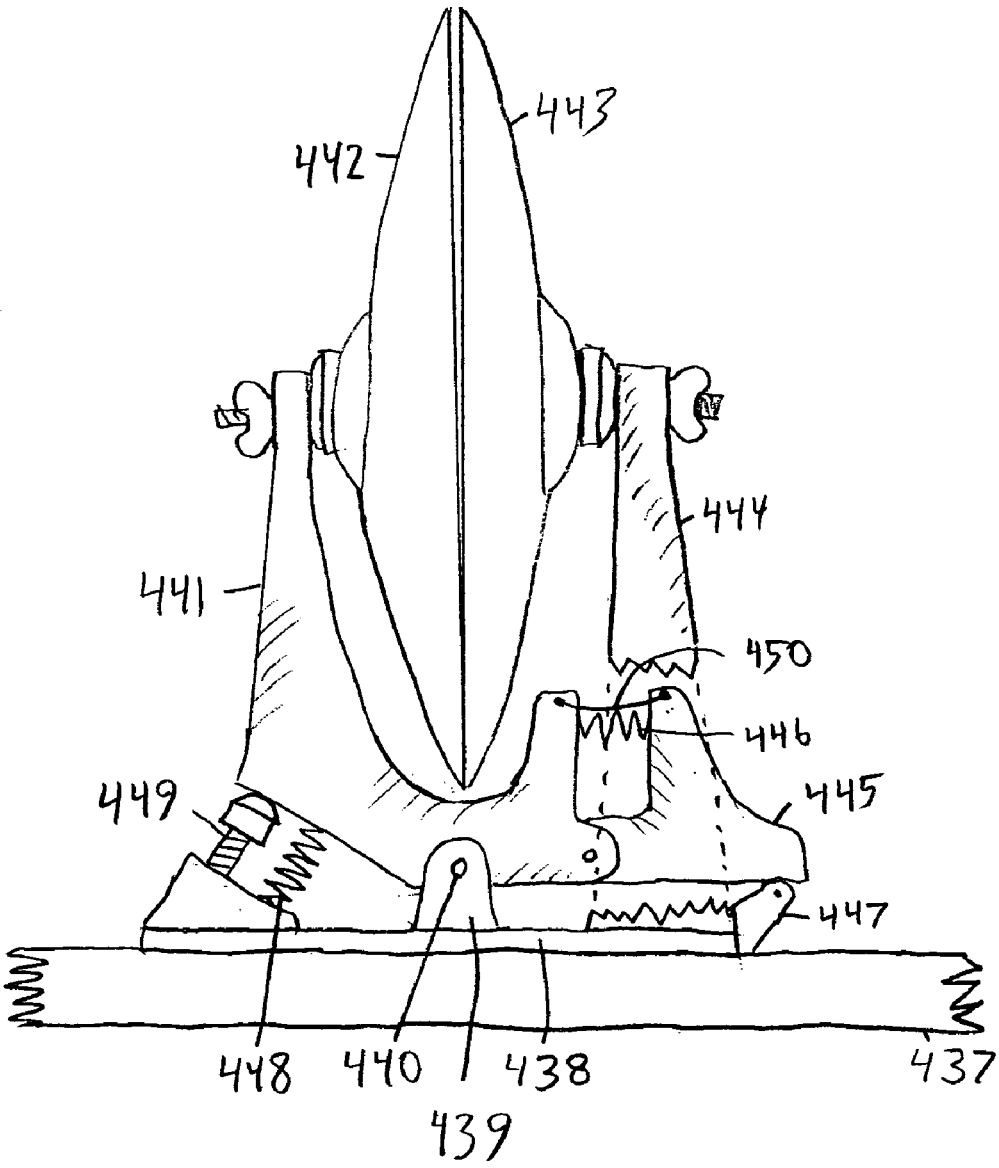
FIG. 32 shows a side view of a open-on-downstroke hi-hat mechanism.
Figure 35:
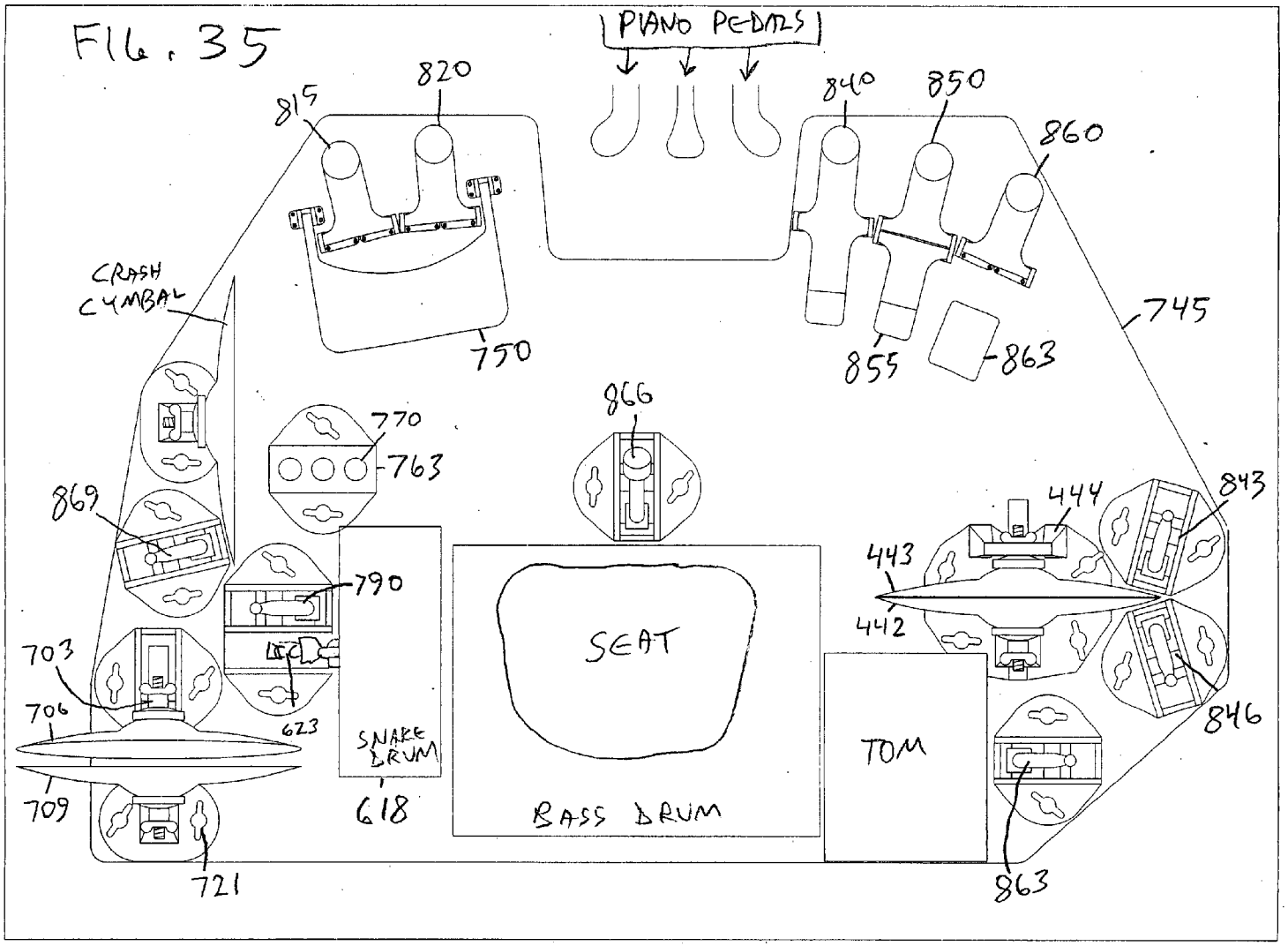
FIG. 35 shows an overhead view of a drum/pedal layout according to the invention.

An alternate hi-hat opening mechanism is shown in side view in FIG. 32. An overhead view of this mechanism is shown in FIG. 35. Mounted on the base member 437 may be a stationary plate 438 which may include a vertically-extending fork 439 with a pivot 440. Another vertically-extending fork with pivot, not visible in FIG. 32, may be to the rear of fork 439. Between these two forks and rotatably-mounted on pivot 440 may be a movable-cymbal-holding arm 441. Attached to this arm may be a cymbal 442. A stationary cymbal 443 may also be provided, mounted on a pair of vertically-extending forks 444, one of which is visible in FIG. 32. Between these forks may be an intermediate arm 445, pivotally mounted on arm 441. A compression coil spring 446 may push intermediate arm downward relative to arm 441. A slave rotor 447 may be provided which applies upward force on intermediate arm 445 when the corresponding pedal (not shown in FIG. 32) is depressed as shown. In this configuration, spring 446 is compressed, applying a torque to arm 441. This torque, which is counterclockwise from the perspective of FIG. 32, rotates arm 441 slightly. This rotation of arm 441 compresses a compression coil spring 448 and opens the cymbals slightly. The degree of cymbal opening may be adjusted by rotation of a machine screw 449. When the pedal is released, the drive point of rotor 447 descends, the two springs expand, and the cymbals close. Expansion of spring 446 is limited by a cable 450, shown in limp state in FIG. 32. Cymbal strikers and means for attaching plate 438 to base member 437, e.g., wing-head bolts and T-nuts, are not shown in FIG. 32, but can be seen in FIG. 35.

Figure 22:
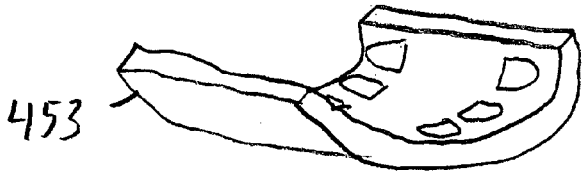
FIG. 22 is a conceptual perspective drawing of a concave array of foot pedals.

Referring again to FIG. 16, one can see how multiple instruments can be played by one foot. A stationary pad 452 is provided which the musician can rest his/her foot on. An array of pedals as in FIG. 16 can be placed on an arced base plate 453 as shown (badly drawn) in FIG. 22. The center of the arc is coaxial with the seated musician's femur. The advantage of this type of base plate is that it is more comfortable for the musician to reach all the pedals, since the knee can remain at the same elevation, regardless of which pedal is being struck.

Figure 19:
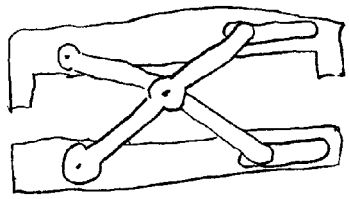
FIG. 19 is a conceptual side view of a pedal with a basic scissors-jack-type leveling mechanism.

The foot pads can be designed so that no fulcrum is required. Key-leveling technology used for oversize computer keyboard keys (e.g., the space bar) can be used. Many examples of such technology can be found in U.S. Patent Class 200/344; for example, a scissors jack as in FIG. 19 and/or a drive rod (not shown, e.g. the wire denoted with reference numeral 26 in U.S. Pat. No. 4,950,093) may be used.

Figure 20:
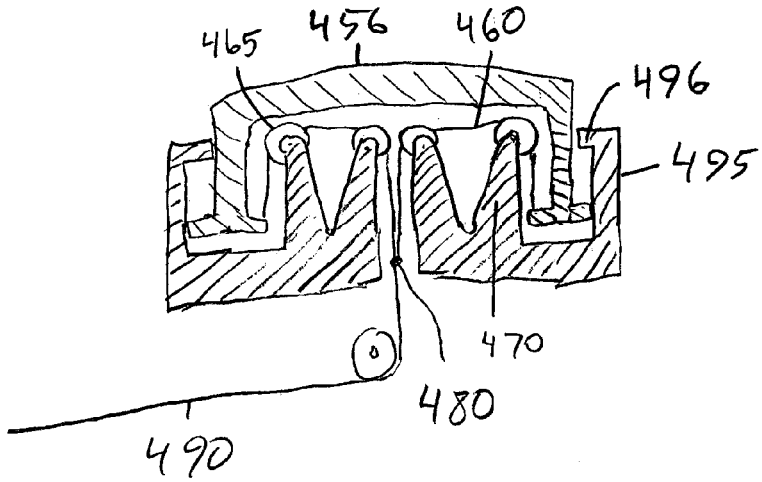
FIG. 20 is a cross-sectional view of a pedal with a cable-based leveling mechanism.
Figure 21:
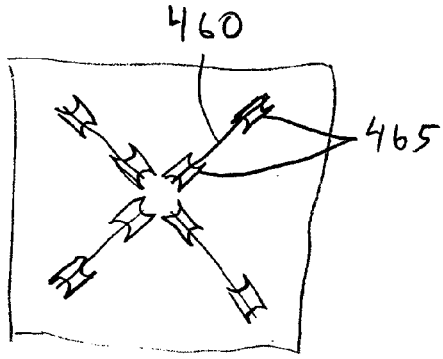
FIG. 21 is an overhead view of the stationary part of the device of FIG. 20.

The need to keep the pad 456 level can be transcended with the design shown in FIGS. 20 & 21. FIG. 20 shows a cross-sectional side view. FIG. 21 is an overhead view. Here, four cables 460 are provided, one attached to each lower inside corner of the pad as shown (only two cables 460 are visible in FIG. 20). Two pulleys 465 for each cable are provided, mounted on stationary pulley mounts 470 (not shown in FIG. 21). These pulleys direct the cables from each corner to the center of the pad, where they extend downward to a knot 480 where they are tied together and to another cable 490 which extends to the slave mechanism. Sideways movement of the pad 456 is restricted by stationary flanges 495 which also include inwardly-extending flanges 496 which limit upward pad movement. Rubber pads should be provided (not shown) to soften both the upward and downward strokes of the pad, thereby reducing noise. With this design the foot can touch the pad at any point on its top surface, and as long as that point is fully depressed, the cable 490 will be pulled the full distance to fully drive the slave mechanism, even if the pad 456 is not level at the bottom of the foot's stroke.

A rim shot striking mechanism is shown in FIG. 27. Attached to a base plate 500 is a snare drum 505. A cable 510 pulls slave swing arm 515 which lifts a horizontal arm 520 which is swingably mounted on a stationary pivot structure 525. Independently swingably mounted on pivot structure 525 with the same pivot axis as arm 520 is a vertical post 530. A compression coil spring 535 pushes arm 520 and post 530 away from each other. This relative movement is limited by a cable 540. Spring 535 imparts sufficient force on the post 530 so that when the arm 520 is lifted by the swing arm 515, the cable 540 remains at tension, and the post 530 moves with the arm 520. Swingably mounted on the top end of post 530 is a drumstick-holding member 545 which holds a drumstick 547 at approx. the center of the drumstick's length. A coil spring 550 is provided to impart a counter-clockwise (as viewed from above) torque on drumstick-holding member 545. The snare drum 505 and the various elements which support the drumstick 547 are arranged so that the tip 555 of the drumstick is in contact with the head 560 of the snare drum at all times, regardless of where the post 530 is within its stroke arc. As the foot pad (not shown in FIG. 27) is depressed, cable 510 is pulled, raising swing arm 515, lifting arm 520, tilting post 530, and bringing the butt end 565 of the drumstick toward the rim 567 of the snare drum. The elements are arranged so that the drumstick contacts the snare drum rim between the drumstick-holding member 545 and its butt end 565. The various elements are adjusted so that when the foot pad reaches the bottom of its travel, the drumstick is in contact with the snare drum rim and the compression spring 535 is slightly compressed, thus introducing a slight amount of slack in cable 540. Hence, the drumstick does not bounce away from the drum rim as the foot pad is held down, and foot pad depression does not cause damage to any element of the system. Means other than spring 535 may be used to absorb shock. These include stretchability in the cable 510, a rubber pad in place of spring 535, and flexibility in the swing arm 530. The cable 510 may be severed in its middle, and an expansion coil spring may be tied to each severed end (not shown). It is recommended that a patch (not shown) be placed on the drum head at the spot where the drumstick tip makes contact. An example of such a patch is item # EQPC1, made by the Evans Drumhead company of Farmingdale, N.Y.

FIG. 29 shows an overhead view of an alternate rim-shot playing apparatus. A coil spring 585 holds the drumstick at an angle as shown. The spring serves three functions: 1) It keeps the tip of the drumstick in contact with the drum head, 2) it provides a shock-absorbing function to allow the pedal to travel downward slightly after the drumstick has struck the rim, and 3) it pushes the swing arm 588 away from the drum, pulling the linkage cable (not shown in FIG. 29) and, hence, pushing the pedal up to its rest position when downward foot force is released.

FIG. 30 shows an overhead view of another alternate rim-shot playing apparatus. A drumstick-tip-retaining member 600 is swingably mounted on a stationary mount 603. A spring 606 pulls on member 600. The tip of the drumstick 609 is disposed between member 600 and the drum head. Member 600 pressed the drum stick tip against the drumhead. Member 600, mount 603, and spring 606 may be replaced with a device similar to the EMAD dampener made by the Evans Drumhead company. This dampener is easily mounted to a drum rim.

FIG. 31 shows a side view of another alternate rim-shot playing apparatus shown in strike position. The drum 618 is shown in cross-section. Here the drumstick 620 is vertically-disposed, pivotally mounted on a swing arm 623 on a pivot 624. A spring 626 may be provided to keep the tip of the drumstick in contact with the drum head and push the swing arm 626 away from the drum, pulling the linkage cable 629 and, hence, pushing the pedal (not shown in FIG. 30) up to its rest position when downward foot force is released.

The structures of FIGS. 27 and 29–31 may be combined in numerous ways. For example, spring 585 can be used in the FIG. 31 device instead of pivot 624 and spring 626.

A close-on-downstroke hi-hat mechanism is shown in a side view in rest position in FIG. 36. An overhead view of this mechanism is shown in FIG. 35. This mechanism uses a slave rotor 700 which pushes up a arm 703 which holds a moving hi-hat cymbal 706. A stationary cymbal 709 is also provided, mounted on a support post 712 which is mounted on a base plate 715. Plate 715 is attached to base member 718 with a wing-head machine screw 721 which mates with a T-nut 724. Downward foot pedal movement causes upward movement of rotor 700 which rotates arm 703 and cymbal 706 so that the two cymbals strike each other.

Figure 37:
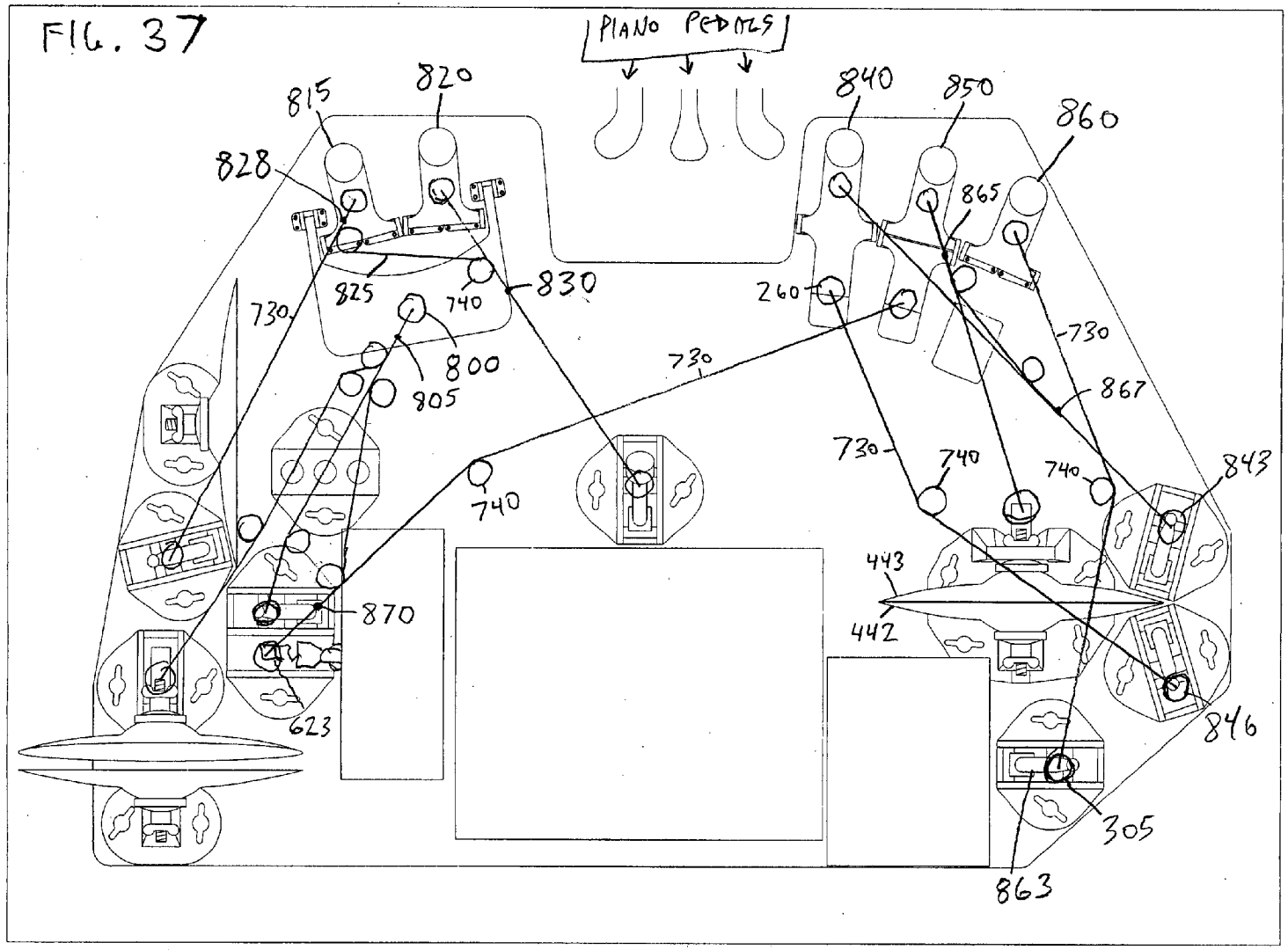
FIG. 37 shows the drum/pedal layout of FIG. 35 with the pedal-to-percussion-instrument linkages.

FIGS. 35 & 37 show overhead views of one drums/pedals layout. It is to be emphasized that this is only one possible layout of the invention. An unlimited number of other layouts are possible as well, using different percussion instruments placed in different locations operated by different pedals.

FIG. 35 shows the percussion instruments and their pedals. FIG. 37 shows the same view of the same elements plus the linkages which connect the pedals with their corresponding percussion instrument manipulation devices. These linkages include cables 730, pulleys 740, and master/slave rotor mounts 260/305 as seen in FIG. 7. The musician sits on a padded seat which is mounted on the bass drum as seen in FIG. 35.

The percussion instruments and their strikers are arranged so that the musician's feet are visible, the strikers are visible, and the plywood base member 745 is small. The percussion instruments are attached to the base member with wing-head machine screws mating with T-nuts as shown in FIG. 36. Microphones may be placed in or near the percussion instruments with ⅛" dia. "mini" plugs. "Mini" audio jacks for these plugs may be installed in the base member with signal cables routed on the underside to a single location for easy connection to a sound mixer. The audio jacks and signal cables are not shown.

FIG. 33 shows a cutaway side view of a selector mechanism which is used to select which device will be operated by the left heel pedal 750. Three pistons 760 slide vertically in a stationary block 763. A ball 766 and spring 767 hold the piston in upper position when pulled to that position by the musician pulling on handle 770. Attached to a linkage cable 773 is a cylinder 776. When pedal 750 is depressed, the cable 773 is pulled and the cylinder 776 is in a position whereby the piston 760 can be lowered to block movement of the cylinder 776. Thus, when the pedal is released, the bottom end of the piston holds the cylinder and the cable, locking the striker in strike position. The cable is then slack between the pedal and the cylinder and downward force applied to the pedal does not cause the striker to strike the percussion instrument. An overview of the selector mechanism is shown in FIG. 34. In the FIGS. 35 & 37 layout, pedal 750 can be used to play any of: a basic snare drum escapement striker 790, a rim shot striker as in FIG. 31, or a close-on-downstroke hi-hat as in FIG. 36.

Referring again to FIGS. 35 & 37, a cable extends from the left heel pedal master rotor 800 to basic snare striker 790.

Tied to this cable at point 805 are two other cables which extend to a close-on-downstroke hi-hat mechanism 703 and a rim-shot mechanism 623. Pulleys are used to guide these cables underneath the selector block 763 and to their respective percussion instrument manipulation devices.

The leftmost toe pedal 815 plays a crash cymbal and a bass drum. The other left toe pedal 820 plays only the bass drum. A connector cable 825 pulls the bass drum cable when pedal 815 is depressed. Cable 825 is tied to the other two cables at points 828 & 830.

The right foot operates a teeter-totter hi-hat pedal 840 which operates two hi-hat strikers 843 & 846. The right foot also plays a center toe pedal 850, a center heel pedal 855, and a rightmost toe pedal 860. A stationary right heel raised pad 863 is also provided which the musician may rest his/her right heel on when playing pedal 860. Downward movement of center toe pedal 850 plays hi-hat striker 843 and also opens the hi-hat cymbals 442 & 443. A connector cable 863 connects two cables as shown at tie points 865 & 867. Center heel pedal 855 moves rim-shot arm 623. The cable from the rotor under pedal 855 is tied to the other rim-shot cable at point 870. Rightmost toe pedal 860 operates a tom drum striker 863.

The tom striker 863, bass drum striker 866, hi-hat strikers 843/846, crash cymbal striker 869, and basic snare striker 790 all use an escapement mechanism which may be similar to the striker action with drumstick as shown in FIG. 3 but driven by a slave rotor as shown in FIG. 7. The bass drum striker includes a felt-mallet striking tip of the type normally found on conventional bass-drum pedals.

FIGS. 23–26 show various foot pad layouts.

Figure 23:
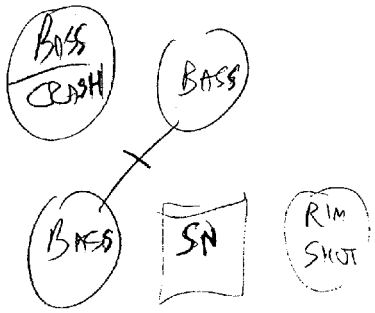
FIGS. 23–26 show various conceptual overhead views of foot pedal layouts.

In FIG. 23, the pad at the upper left simultaneously causes a bass drum strike and crash cymbal strike. The two bass drum pads are connected together in a seesaw pedal as described above. Additional heel pads are a snare pad and a rim shot pad.

Figure 24:
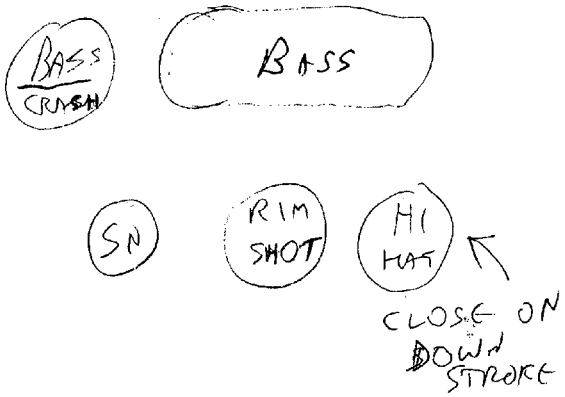
Figure 24:
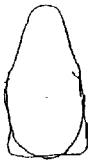

In FIG. 24, an extra-wide bass drum pad is provided. A foot can thus cover both the bass drum pad and any of the three heel pads shown. The rightmost heel pad closes a pair of hi-hat cymbals when depressed. This particular pair of cymbals remain widely open when the pad is up. Such a hi-hat control arrangement is particularly useful for swing-jazz grooves. A ride cymbal (not shown) struck via a foot pad under the other foot can be used in conjunction.

Figure 25:
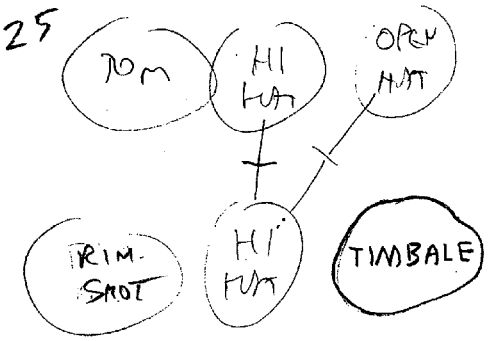
Figure 25:
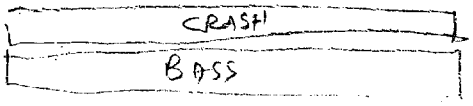

FIG. 25 shows an instrument assignment which may be applied to the pedals of FIG. 16.

Figure 26:
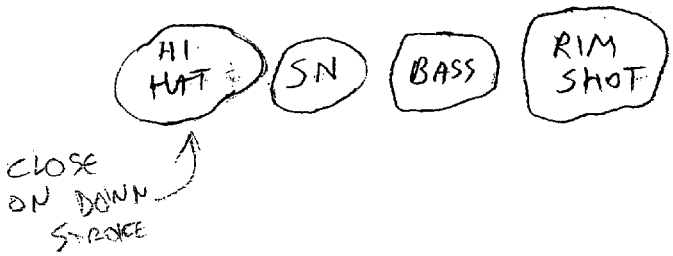

In FIG. 26, an extra-extra-wide-toe bass drum pad is provided, which can be played simultaneously with any one of the four heel pads shown. A second extra-extra wide pad is provided in front of the bass drum pad as shown. This second pad plays a crash cymbal. Thus, the bass drum can be sounded by itself, or, with a more-forward positioning of the foot, the bass drum and crash cymbal can be played together. As in FIG. 23, a heel bass drum pad is provided to enable two bass drum beats to be played in short succession. The heel bass drum pad may seesaw with the wide (toe) bass drum pad, or may drive a second bass drum striking device.

The pedals in any of FIGS. 23–26 may be reversed, i.e., the toe pads may be interchanged with the heel pads. Also, an extra-wide pad may be assigned to any percussion instrument, e.g., a snare drum. Heel pads may be narrower that toe pads or vice versa.

Other types of linkages can be used between the foot pads and the escapement actions. These include tracker rods (as used in old pipe organs), rotating axle rods, and hydraulic systems (e.g., such as the brake system in a standard automobile).

Figure 28:
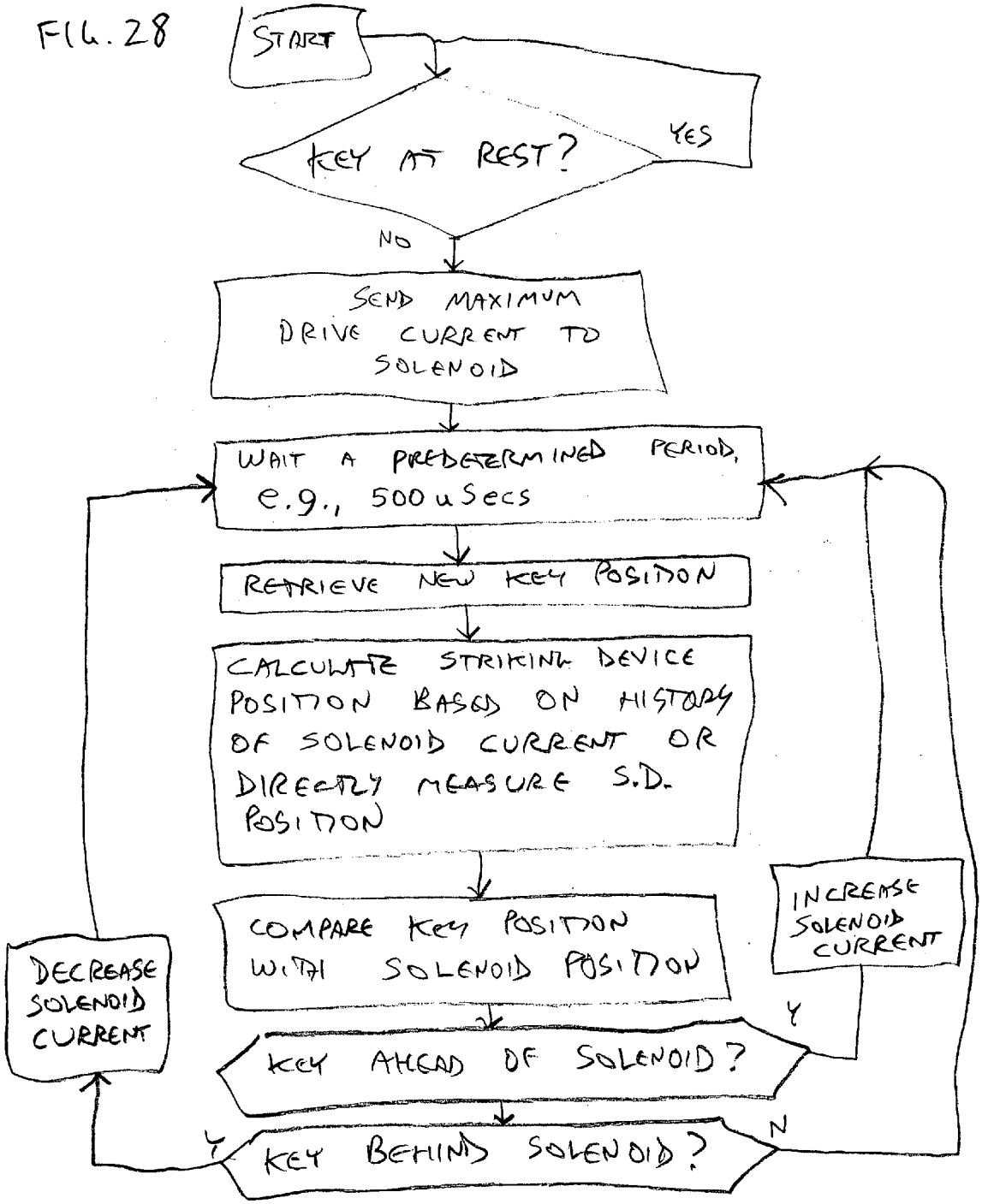
FIG. 28 is a software flow chart for an electromechanical foot-drum system.

An electrical/electronic system may be used in place of a mechanical linkage. Such a system would use a solenoid or other electrical motion-driving device to drive the escapement action or to drive the striking device directly. The foot pad would include position-sensing means, such as, for example, an optical sensor wired to an analog-to-digital converter, which would provide a microprocessor with a numerical value representing the pad's vertical position. A simplified software flow chart for the solenoid control system is shown in FIG. 28. One advantage of an electrical/electronic system is that a control panel including push-buttons or other control mechanism can be used to quickly change the assignment of foot pads to percussion instruments, e.g., for different songs. Also, linking the foot pads and the solenoids to the microprocessor/control unit would be easy since little skill is required to route electrical wires from one location to another.

Pad Width/Spacing:

In designing a foot drums system with several pads placed in a left-right row (for one foot to play several different percussion instruments), one must take several factors into consideration in determining two important linear dimensions. These two dimensions are (1) the left-right width of the pads, and (2) the center-to-center distance between adjacent pads (the "pitch" of the pads). The pad width should be wide enough that striking the pads is comfortable and satisfying for the musician. The wider the pads, the more comfortable it will be to strike any one. However, the comfort advantage essentially vanishes when the pads are wider than about 15 cm or so; and the wider the pads, the greater must be the pitch. A wide pitch is undesirable since there is only a limited left-right distance over which a seated musician can comfortably reach his/her feet; and one may wish to include as many different instruments/pads as possible within this range of comfort. Also, it is recommended that a space of at least approx. 6 cm be left between adjacent pads. This space makes it easier for the musician to feel when his/her foot is drifting to the side while repeatedly striking a particular pad. With this feedback, the musician can correct the foot's position before accidentally striking the adjacent pad. A convex top pad surface can provide this tactile feedback as well, but the musician may want to aggressively strike the pads barefoot or with soft-soled shoes, and in this event convex tops may be uncomfortable. Thus, a space between pads is recommended, and this space further limits the designer's ability to provide both wide pads and short pitch.

To properly balance these two desirable features, it is recommended that the instrument designer first determine three numerical values.

The first of these values is a width estimate of the portion of the foot which will be striking the pads. Typically the ball of the foot is the widest section, approx. 11 cm. The heel of a foot is typically approx. 8 cm.

Then the minimum pad width should be decided upon. 5 cm is recommended.

Next the designer should consider how likely it is that the musician will want to deliberately strike two adjacent pads simultaneously. A musician may want to use this technique frequently, e.g., to play a bass drum and crash cymbal at the same time. The pads may be designed/laid out so that this action is easy (likely) or difficult (unlikely). This relative likelihood can be mathematically quantified by asking the following question: If the section of the foot which normally strikes a row of pads strikes the pads in a random left-right location, what is the chance that the strike will depress a single pad versus two at once? Or, to put it another way, what portion of the pitch distance corresponds with a single strike, what portion corresponds with a double strike, and what is the ratio between these two linear distance values? A designer may want the ratio to be even (50/50) or perhaps would prefer a greater likelihood of single strikes, depending on which instruments are played by adjacent pads and what sort of playing style the musician prefers.

When these three numerical values have been determined, the required pitch can be calculated using this equation:

$$\text{Required Pitch} = \frac{A(B+1)}{2+B}$$

Where:

$A$=Minimum Pad Width+Foot Width, and $$B = \text{Desired Ratio of } \frac{\text{Single-strike Distance Within the Pitch}}{\text{Double-strike Distance Within the Pitch}}$$

Example:

For a pad width of 5 cm, a foot width of 11 cm, and a ratio of 2/1 (a single strike is twice as likely as a double strike), the pitch should be 12 cm. With these values, the space between adjacent pads is 7 cm. 8 cm of the 12 cm pitch will correspond with single strikes, and 4 cm will correspond with double strikes. A smaller space between pads (and hence a smaller pitch) will probably be desirable in most cases. 5 cm pads with 5 cm spaces between them have been found to be generally satisfying. It should be noted that pads are generally not struck with the widest foot area (the ball of the foot), but rather with an area closer to the toe-tip or with the heel.

Pad Depth:

The front-rear depth of the pads is less critical than the width. Toe pads can be square, i.e., the width and depth can be the same. Heel pads should be at least approx. 6 cm deep so a double-strike can be comfortably performed with the heel. A heel double-strike consists of a first heel strike performed with the toe on the toe pad as the lower leg and heel are brought downward. Immediately after the first strike, the toe remains on the toe pad as the lower leg bounces up with aid of the quadriceps, which hold the leg in raised position. The toe is then lifted, resulting in a second strike on the heel pad. This technique has been found to be a valuable skill, since two heel strikes in rapid succession are very difficult to perform when the entire lower leg must be accelerated up and down again between strikes.

Alternate Pedal Axis of Movement:

Rather than moving up and down, a pedal may instead be mounted on a vertical rotational axis, whereby foot pads move is a side-to-side arc. Such a pedal might be useful for hi-hat playing.

CONCLUSION, RAMIFICATIONS, AND SCOPE

The present invention has numerous advantages over the prior art.

By placing the pedal-to-striker linkage system within a single rigid sheet (instead of between two sheets as Davies & Grilli) vertical height between the floor and the top of the pedal is greatly reduced.

By using upward slave rotor movement to drive percussion instrument manipulation devices, a standard is created whereby different devices may easily be assigned to different locations. Hence a great deal of versatility is possible with low manufacturing tooling costs. Different musicians can easily design different instrument/pedal layouts to suit their particular needs. Standard sheets may be used (e.g., 19 mm plywood), and the rotor mounts may be made to standard diameters. The pedals, linkages, and mounts for the percussion instrument manipulation devices and percussion instruments can also be easily installed; and the channels for the underside cables may be easily cut with a standard high-RPM electric router. Hence, musicians who possess basic woodworking skills can, with clear written instructions, construct their own base members. The cost of the parts alone may be low, thus making the invention inexpensive to these users.

Since the strikers are driven by a mechanism which includes an escapement, the strikers strike the instruments at approximately the same instant as their corresponding pedals bottom out. Thus, the audio experience of hearing the strike corresponds with the physical experience of feeling the pedal hit bottom, making the act of playing the instrument very satisfying. Also, the escapement "let-off" which is felt in the musician's foot during downstroke after the striker release point is passed is another satisfying aspect of the experience.

The invention allows the linkages between pedals and percussion instrument manipulation devices to present low friction to movement, thus foot energy is used efficiently, and fatigue is minimized.

Many modifications of the invention are possible. The scope of the invention is thus in no way to be considered limited by the preferred embodiments described above; but rather, by the allowed claims and their equivalents.

I claim:

1. An apparatus for playing multiple percussion instruments by foot comprising:

a multiplicity of percussion instrument manipulation devices, a horizontally-disposed rigid sheet base member incorporating a multiplicity of motion transfer systems, at least two of said systems respectively corresponding with at least two of said percussion instrument manipulation devices, each of said two systems comprising:

a master rotor and a slave rotor, each rotor pivotally attached to said base member on a substantially horizontal rotational axis, and each rotor including a drive contact point and a line contact point, a line including a master end and a slave end, each end anchored to its corresponding rotor and extending substantially horizontally away from its corresponding rotor's line contact point, whereby master rotor rotation resulting from downward force applied to said master rotor drive contact point results in horizontal movement of said line, rotation of said slave rotor and upward movement of said slave rotor drive contact point, and said corresponding percussion instrument manipulation device is driven by said upward movement of said slave rotor drive contact point.

2. An apparatus as in claim 1 wherein said rotor is disposed with its rotational axis higher in elevation than its line contact point.

3. An apparatus as in claim 1 wherein said base member comprises a sheet made of wood.

4. An apparatus as in claim 3 wherein said base member comprises a sheet of the type selected from the group consisting of plywood and particle board.

5. An apparatus as in claim 1 wherein said master and slave rotors are substantially identical in structure.

6. An apparatus as in claim 1 further comprising:

a coil spring disposed to impart rotational force to said slave rotor whereby, under normal circumstances, said line is substantially held under tension at all times.

7. An apparatus as in claim 1 further comprising:

a foot pedal disposed over said master rotor whereby, downward movement of said foot pedal causes force to be applied to said master rotor drive contact point, thus causing rotation of said master and slave rotors.

8. An apparatus as in claim 1 wherein said line comprises a structure selected from the group consisting of a cable, a wire, and a tracker.

9. An apparatus as in claim 1 wherein said percussion instruments and said percussion instrument manipulation devices are attached to said base member during use, and said percussion instruments and said percussion instrument manipulation devices are easily detachable from said base member, whereby said base member may easily be placed in a state of low vertical thickness for easy transport.

10. An apparatus as in claim 1 wherein said line passes through a channel in the underside of said base member.

11. An apparatus as in claim 1 further comprising:

a roller mounted on a substantially horizontal axis at the drive contact point of at least one of said rotors wherein the horizontal axis of said roller and the horizontal axis of its corresponding rotor are substantially parallel.

12. An apparatus as in claim 1 further comprising:

a substantially cylindrical-shaped rotor mount wherein, at least one of said rotors is pivotally attached to said rotor mount, and said rotor mount is inserted into a bore in said base member with its center axis substantially vertical.

13. A system for playing a percussion instrument by foot comprising:

a striking device pivotally mounted to strike said instrument, said striking device driven toward the percussion instrument by a drive mechanism, said drive mechanism including a mechanical movement input member, a foot pedal which moves downward from a rest position to a release position and further downward to a lower limit of travel position as downward force is applied, and linkage means for transferring downward movement of said pedal to said drive mechanism input member wherein said drive mechanism includes an escapement whereby said striking device is disengaged from said drive mechanism when said pedal is below said release position.

14. An apparatus as in claim 13 further comprising:

a backcheck for catching said striking device after it has struck and bounced away from said instrument whereby said striking device is prevented from bouncing back toward said instrument.

15. An apparatus as in claim 13 wherein said escapement includes a jack which is driven by said input member to propel said striking device toward said instrument, and a letoff device to disengage said jack from propelling said striking device during a continuous downward pedal movement shortly before said striking device strikes said instrument.

16. An apparatus for playing a hi-hat by at least one foot comprising:

a stationary cymbal, a moveable cymbal disposed substantially coaxially with said stationary cymbal and mounted to reciprocate between a first position and a second position, a striking device swingably mounted to strike one of said cymbals, a first foot pedal linked to said striking device whereby downward movement of said first pedal causes said striking device to strike one of said cymbals, and a second pedal linked to said moveable cymbal whereby downward movement of said second pedal from its rest position to its depressed position causes said moveable cymbal to move from said first position to said second position, wherein said moveable cymbal exerts more pressure against said stationary cymbal when said moveable cymbal is in said first position than when said moveable cymbal is in said second position.

17. An apparatus as in claim 16 wherein said second pedal is mechanically linked to said first pedal whereby depression of said second pedal causes depression of said first pedal.

18. An apparatus as in claim 16 further comprising:

a second striking device swingably mounted to strike one of said cymbals and linked to said second pedal whereby downward movement of said second pedal causes said striking device to strike one of said cymbals.

19. An apparatus as in claim 16 further comprising:

a spring disposed to apply compressive force to the two cymbals relative to each other when said second pedal is in its rest position.

20. An apparatus as in claim 16 wherein the two cymbals are in at least partial contact with each other when said moveable cymbal is in said second position.

* * * * *